US005244001A

United States Patent [19]

Lynch

[11] Patent Number: 5,244,001

[45] Date of Patent: Sep. 14, 1993

[54] COLLAPSIBLE CANOPY FRAMEWORK HAVING CAPTURED SCISSOR ENDS WITH NON-COMPRESSIVE PIVOTS

[76] Inventor: James P. Lynch, 13 S. Field, Lakewood, Colo. 80226

[21] Appl. No.: 632,767

[22] Filed: Jan. 4, 1991

[51] Int. Cl.[5] ..... E04H 15/38

[52] U.S. Cl. ..... 135/103; 135/110; 135/112; 403/175; 403/172

[58] Field of Search ..... 135/110, 111, 103, 106, 135/109, 107, 108, 112, 97, 25.2, 25.3, 25.31; 52/109; 403/172, 175, 176, 178, 218

[56] References Cited

U.S. PATENT DOCUMENTS

| | | | |
|---|---|---|---|
| 402,755 | 5/1889 | Lyon | 135/103 X |
| 2,940,709 | 6/1960 | Neuwirth | 403/176 X |
| 4,318,629 | 3/1982 | Yamamoto | 403/172 X |
| 4,370,073 | 1/1983 | Ohme | 403/172 |
| 4,516,376 | 5/1985 | King | 403/176 X |
| 4,724,642 | 2/1988 | Hoffman et al. | 403/178 X |
| 4,739,783 | 4/1988 | Yang | 135/25.3 |
| 4,885,891 | 12/1989 | Lynch | 135/110 X |
| 4,941,499 | 7/1990 | Pelsue et al. | 403/172 X |

FOREIGN PATENT DOCUMENTS

| | | | |
|---|---|---|---|
| 2525565 | 12/1976 | Fed. Rep. of Germany | 403/172 |
| 372840 | 4/1907 | France | 403/175 |
| 1514258 | 2/1968 | France | 403/175 |

*Primary Examiner*—Carl D. Friedman

*Assistant Examiner*—Lan M. Mai

*Attorney, Agent, or Firm*—Timothy J. Martin; Dana S. Rewoldt

[57] ABSTRACT

An expandable framework structure can be folded for storage and expanded for use, especially as a canopy when a covering is placed on top of the framework. The framework includes a plurality of upright supports and a plurality of edge scissor assemblies that interconnect adjacent ones of the upright supports. Mounts are disposed on the upright supports to fasten outer, rectangular end portions of the edge scissor assemblies. The mounts have sockets which have facing, parallel sidewall portions to receive the rectangular end portions in close-fitted engagement along planar contact surfaces to resist lateral and torsional deflections of the edge scissor assemblies. A fastening pin pivotally secures the outer end of each edge scissor assemblies in its respective socket. The mounts on each upright support are relatively movable to allow expansion and contraction of the framework; one mount is preferably a stationary mount and the other a slide mount. A roof support assembly may be used to support a canopy covering, and several embodiments of the roof support assembly are described. Each edge scissor assembly may be formed of a pair of scissor units interconnected by floating mounts that are provided with sockets and planar contact surfaces to resist lateral and torsional deflection of the scissor units.

22 Claims, 15 Drawing Sheets

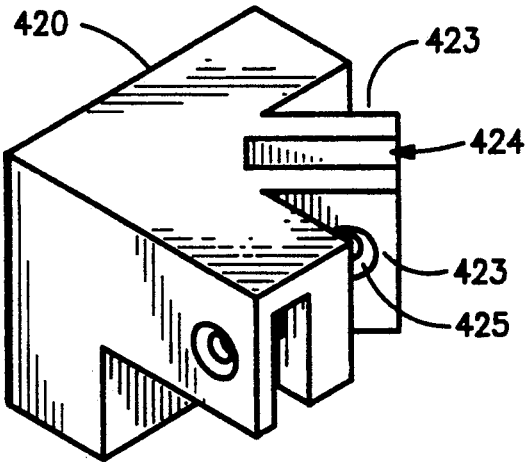
Fig. 23
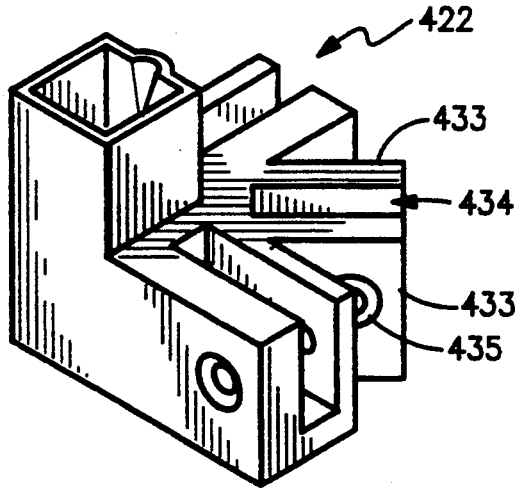
Fig. 24
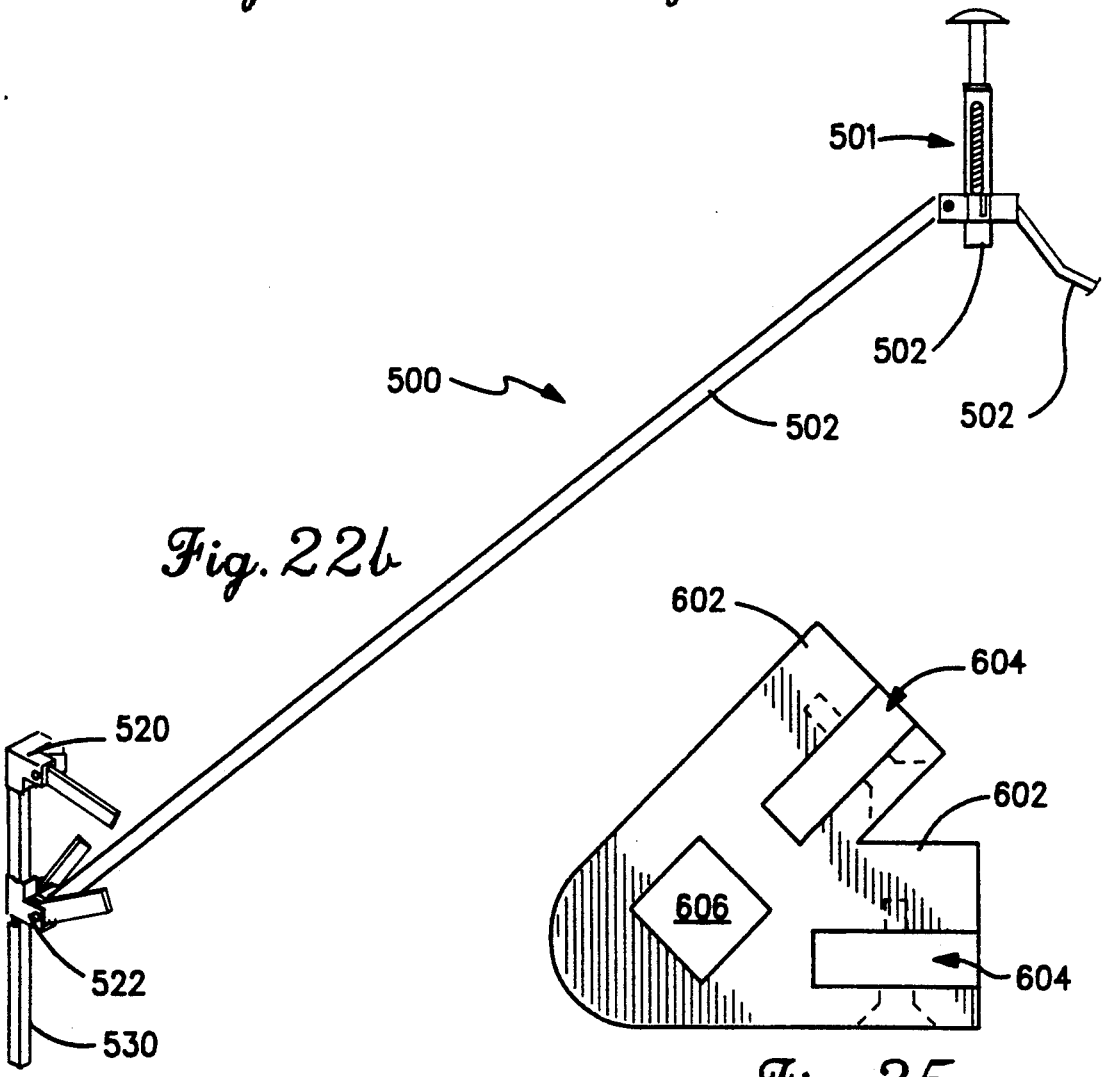
Fig. 22b
Fig. 25

COLLAPSIBLE CANOPY FRAMEWORK HAVING CAPTURED SCISSOR ENDS WITH NON-COMPRESSIVE PIVOTS

RELATED PATENTS

The present application is directed to improvements to certain inventions as disclosed in my earlier patents. Specifically, the present invention relates to U.S. Pat. No. 4,641,676, issued Feb. 10, 1987; U.S. Pat. No. 4,779,635, issued Oct. 25, 1988; and U.S. Pat. No. 4,947,884, issued Aug. 14, 1990, The disclosures of each of the three patents noted above are incorporated in their entirety by this reference.

FIELD OF INVENTION

The present invention generally relates to improvements in collapsible shelters or canopy structures which may be used to temporarily shelter against the elements, to provide privacy and the like, such as shelters described in my earlier disclosed scissor canopy structures referenced above. Specifically, however, the present invention relates to a structural device, in the form of a non-compressible mount having sockets, which capture end portions of scissor assemblies so as to connect scissor assemblies to each other and to other structural components of a canopy structure. The mounts are structured to provide free pivots while at the same time resisting lateral and torsional deflections. Accordingly, the present invention generally relates to the attachment of pivoting structural members in an integrated canopy system.

BACKGROUND OF THE INVENTION

As noted in my earlier patents, portable shelters have been in existence since prehistoric times. Recently, there has been an increase in the sophistication, quality and construction of portable structure apparatus. Relatively large area, temporary shelters which may be stored in the small collapsed state but which may be expanded with a minimum amount of effort and sturdy, large area shelters are known and are discussed in my earlier three patents as well as the references known in the art. These shelters typically employ a framework that supports a lightweight fabric roof or covering for shade, for privacy, or for protection against natural elements such as wind and rain. Side panels may also be used for background display, in the form of protective netting against insects, for privacy and the like. Often, the shelters to which the present invention is directed are those which are used for purposes of recreation, fairs, bazaars, outdoor exhibitions and food and beverage vending, to name a few.

As noted above, one response to the need for portable shelters was shown in my U.S. Pat. No. 4,641,676. This patent discloses a portable canopy structure which has a framework that may be collapsed into a stored state yet which may be expanded and erected for use. The framework includes a plurality of upright support members, the adjacent ones of which are connected by means of scissor assemblies comprising either single or dual scissor units connected in end-to-end relation. A flexible covering extends over the framework. In several of the embodiments, a central support is provided for the covering in the form of a central post so that the covering is supported in a dome-like manner. In another embodiment, no central post structure is shown. The invention described in U.S. Pat. No. 4,641,676 is also somewhat to that described in U.S. Pat. No. 4,607,656 issued Aug. 26, 1986 to Carter.

A problem experienced by the structures shown in Pat. No. '676 (Lynch) and in Pat. No. '656 (Carter) is that the edge scissor assemblies which extend between adjacent support members are often subjected to lateral forces which tend to decrease their stability. Where the scissor assemblies are connected to each other and to the corner supports, compression mounts were used which, if tightened, inhibited the scissoring action and were subjected to shear forces upon lateral deflection. It was often found that the connecting bolts could be bent or broken by excessive lateral deflections.

The structure described in my Pat. No. '676 was greatly improved by that disclosed in my U.S. Pat. No. 4,779,635 issued Oct. 15, 1988. In this patent, the canopy structure outwardly biased its corner support members so that the framework interconnecting adjacent corner support members was placed in tension as opposed to compression, which was the case in my Pat. No. '676. Nonetheless, the assembly shown in my Pat. No. '635 was still subject to improvement in the scissor bar interconnections. Likewise, the structure shown in Pat. No. '884 while providing a very useful canopy of an auto-erect feature relied on similar scissor bar interconnecting bolts which, while quite workable, had the disadvantages indicated above.

In an effort to further stabilize my collapsible canopy structures and meet the aforementioned problem, I developed a stabilization bar for use with these scissor assemblies. The construction and attachment of this stabilization bar is described thoroughly in my U.S. Pat. No. 4,885,891 issued Dec. 12, 1989 for reinforcement member for an extendible scissors truss. It was noted in that patent that conventional extendible scissor trusses have great strength and may be very stiff in resisting loads resulting from forces in the plane of their trues cells and related moments normal to those cells, but that such scissor assemblies are generally weak and relatively flexible when subjected to side loads imposed by forces acting normal to the plane of the truss cells and weak with respect to the related moments lying in the planes of the cells. This problem was solved, in part, by the inclusion of a reinforcement member having end portions which extend along side a facing pair of scissor bars of two scissor units which are connected in end-to-end relation. A linking portion extends between the end portions and rigidly joins them. This structure thus defines lever members which produce moment couples on he truss members with these lever members then resisting torsional and bending stress forces.

While the structure described in my patent '891 works quite well, it adds additional complexity to the structure the collapsible unit to which it is attached and thus increases manufacturing costs and weight. There therefore remained a need for still further improvements and stabilizing truss assemblies, particularly where those truss assemblies are incorporated into collapsible canopy structure. There is a further need recognized when products are manufactured according to my above referenced patents in simplifying the mounting of the scissor bar elements, one to another into scissor units and the resulting scissor units into interconnected scissor or truss assemblies, and in the connection of such truss assemblies in a pivotal expandable/collapsible manner to respective corner and intermediate supports. There is further a recognized need for interconnections which would be more resistive to shear and bending moments.

SUMMARY OF THE INVENTION

It is an object of the present invention to provide a new and useful framework construction particularly adapted for expandable shelters which structure simplifies interconnection of the various structural members while at the same time being resistive to lateral forces.

Another object of the present invention is to provide connecting devices for scissoring elements in truss assemblies which connectors are non-compressive so as to allow a scissor forming element to freely pivot therein while at the same time resisting lateral and torsional deformations of the element.

A further object of the present invention is to provide connecting devices which may be used in expandable shelter which connecting devices employ a minimum of different pieces which may be integrated into a more complex structure.

Yet another object of the present invention is to simplify collapsible canopy structure by providing new and useful mounts for interconnecting the structure forming elements.

Still a further object of the present invention is to provide a collapsible/expandable framework structure for canopies with which may be employed lighter weight corner supports and scissors bars without significant loss of structural integrity or strength.

Another object of the present invention is to provide connector pieces which may interconnect the scissor bars forming scissor units and scissor units into scissor assemblies which may thereafter be connected to upright support members in such a manner that the free ends of the respective scissor bars are captured and protected in a non-compressive manner.

According to the present invention, then, an expandable framework structure is provided. This framework structure is adapted to be folded and stored in a collapsed state and erected in an expanded state on a support surface in order to support a canopy covering above the support surface. The expandable framework broadly includes a plurality of upright support members each having a bottom end positionable on the support surface and a top end opposite the bottom end. In the collapsed state, the support members are oriented alongside one another but are movable outwardly apart from one another towards the expanded state.

A plurality of edge scissor assemblies form truss members for the expandable framework with there being an edge scissor assembly interconnecting adjacent ones of the support members. Each edge scissor assembly has a pair of outer upper ends and a pair of outer lower ends, a plurality of novel mounts are disposed on the upright support members to fasten the edge scissor assemblies thereto. To this end, each of the mounts have sockets formed therein by spaced-apart facing sidewall portions so that the outer ends of the edge scissor assemblies may be captured in respective one of the sockets in close fitted engagement between the facing sidewall portions thereof. A fastening pin pivotally secures each outer end portion of each edge scissor assembly in its respective socket.

The mounts are relatively movable with respect to one another so that the edge scissor assemblies are operative to open and close whereby the framework structure may move between the expanded and contracted states. Accordingly, where a pair of mounts are positioned on an upright support member, one mount is stationary while the other is slideable. The sockets and the mounts thus provide pivotal connections for the scissor bars which form the scissor units which in turn comprise the scissor assemblies without being compressive fittings. Nonetheless, the sidewalls act to resist lateral and torsional deflections of the outer end portions of the edge scissor assemblies, and thus the scissor assemblies themselves.

In the preferred structure, a roof support assembly is provided, which can be of a variety of types. In one construction, the side edge scissor assemblies are each formed by a plurality of scissor units with adjacent inner ends of the scissor units being connected together by means of a floating mount, again provided with sockets and fastening pins to pivotally secure inner ends of the scissor bars within the sockets. The roof support assembly can then be formed as one or more internal scissor assemblies which extend between facing side edge assemblies so as to have outer end portions attached to the floating sockets. These internal scissor assemblies are each formed by a plurality of scissor units, and central mounts may be provided with sockets to receive inner end portions of the scissor units which form the internal scissor assemblies. A center post structure may be provided in this construction.

In another construction, the roof support assembly may be extendible roof members pivotally attached to the stationary mounts at upper ends of the upright support members with these roof members projecting radially inwardly to form one or more apices to support the canopy covering. Alternately, the roof support members may extend radially inwardly from the slide mounts to form such apex.

It is desirable in these structures that suitable latches be provided to maintain the framework in the erected and expanded state. When in the collapsed state, the framework structure defines a closed framework unit having opposite framework unit ends. The stationary mounts and the floating mounts are configured so that, in the collapsed state, the stationary mounts and some of the floating mounts at the first framework end creates an uninterrupted first rim around that end while the slide mounts and the other floating mounts at the second end of the framework unit abut one another to create an uninterrupted second rim. In any event, each of the scissor units are pivotally connected to one another at a common mid-point on a pivot axle that is again a non-compressive joint. Preferably, the scissor bars are tubular members of aluminum or other structural material such as steel, plastic or figerglass and having a rectangular cross-section of the selected width and height with the width being less than the height. When connected, the pivot axle extends across the respective widths of the scissor bars. The pivot axle is preferably formed by a pair of cooperating axle pins which matably connect to one another to define spaced-apart heads between which the scissor bars are positioned. These cooperative axle pins are configured so as to limit the minimum distance between the heads to at least a distance equal to the combined widths of the scissor bars so that the axle pins do not compress the pair of scissor bars therebetween.

Where larger areas are to be protected by the canopy structure, some of the upright support members define corner supports while others define intermediate supports which have their respective stationary mounts and slide mounts. Thus, a wide variety of combinations of scissor assemblies may be joined together to create the large area framework structure as desired.

These and other objects of the present invention will become more readily appreciated and understood from a consideration of the following detailed description of the preferred embodiment when taken together with the accompanying drawings, in which:

BRIEF DESCRIPTION OF THE DRAWINGS

FIG. 23 is a perspective view of a stationary mount which may be used with the roof support structures of FIGS. 22(*a*) and 22(*b*);

FIG. 24 is a perspective view of a slide mount which may be used with the roof support structures of FIGS. 22(*a*) and 22(*b*); and FIG. 25 is a bottom plan view of a stationary mount which may be used with a triangular framework structure according to the exemplary embodiments of the present invention.

DETAILED DESCRIPTION OF THE PREFERRED EMBODIMENT

The present invention concerns movable or temporary shelters in the form of canopy structures which may be stored in a compact size yet which may be expanded into an erect structure providing shelter against the elements or which provide privacy for a variety of applications. The structures of the present invention do not require any assembly or disassembly. Such structures are those which, by way of example and not limitation, are described in my issued U.S. Pat. Nos. 4,641,676, 4,779,635 and 4,947,884. The present invention specifically concerns novel mounts which may be used to interconnect the framework forming elements, such as the upright corner and intermediate leg support members, scissor assemblies and roof support structures described in those issued patents, a detailed description of those structures is not again here set forth but rather the structures and technology disclosed in those issued patents are herein incorporated by reference.

Figure 1A:
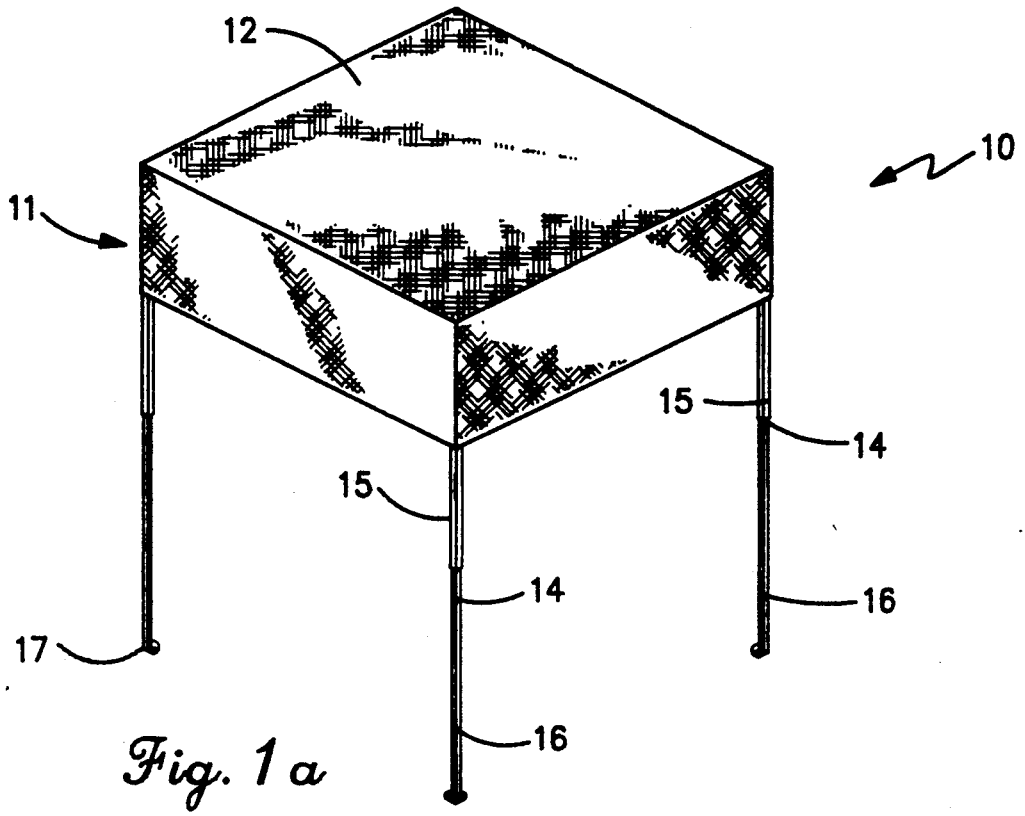
FIGS. 1(*a*), 1(*b*) and 1(*c*) are perspective views showing three specific exemplary canopy units made according to the teachings of the present invention.
Figure 1B:
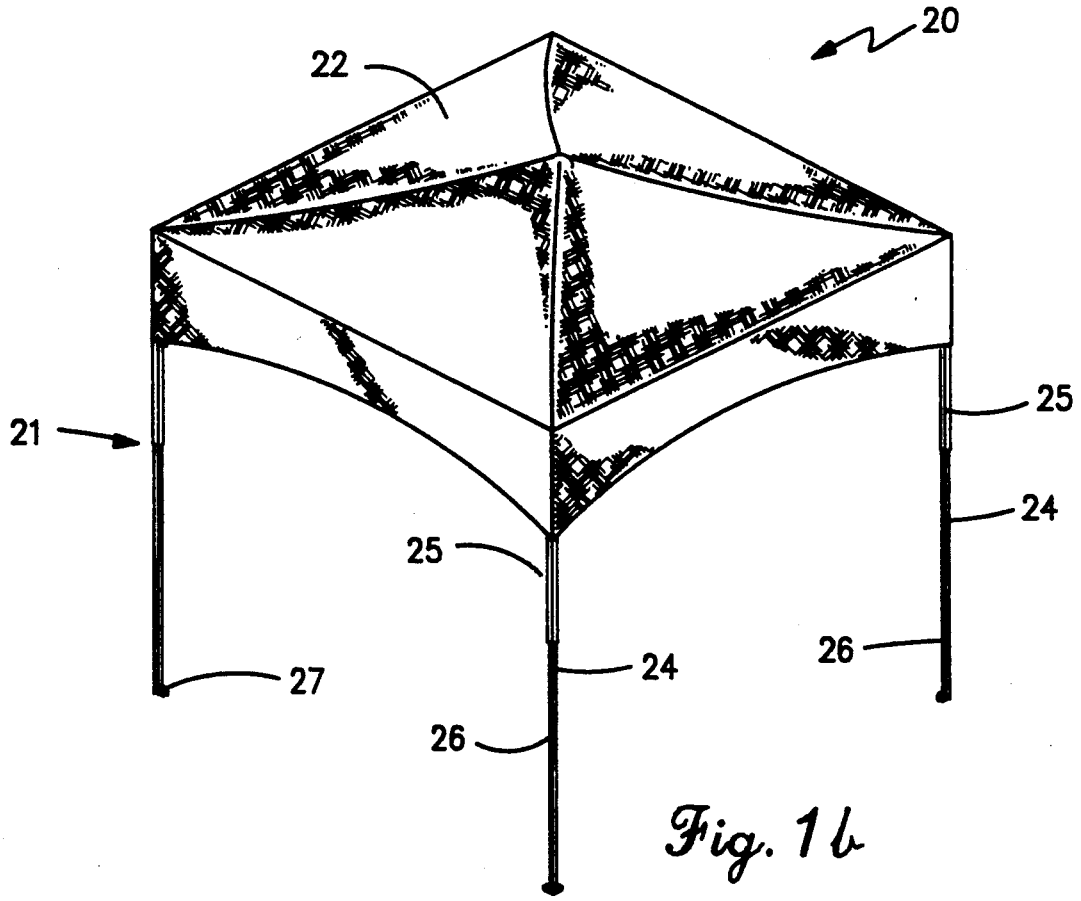
Figure 1C:
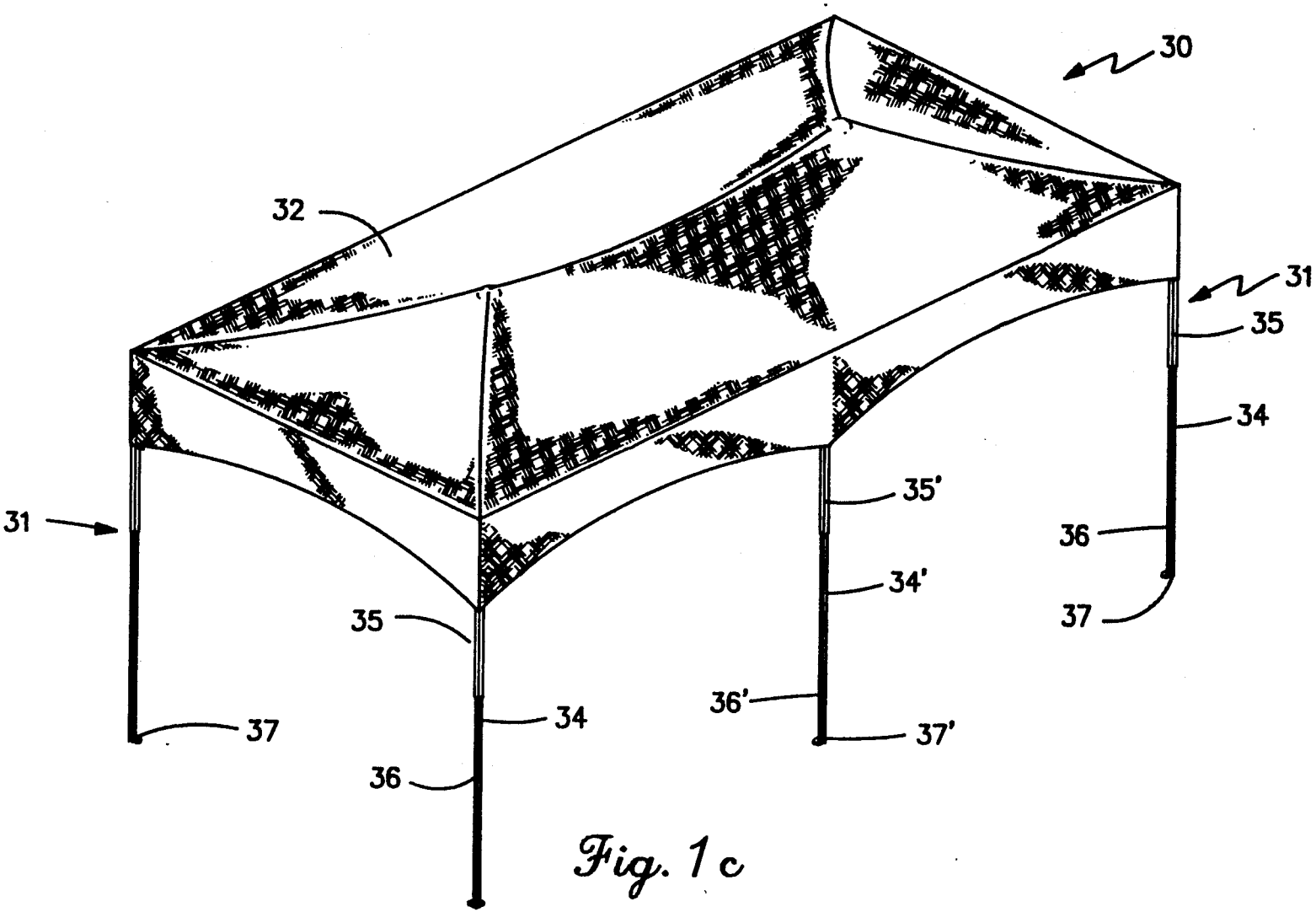
Figure 2A:
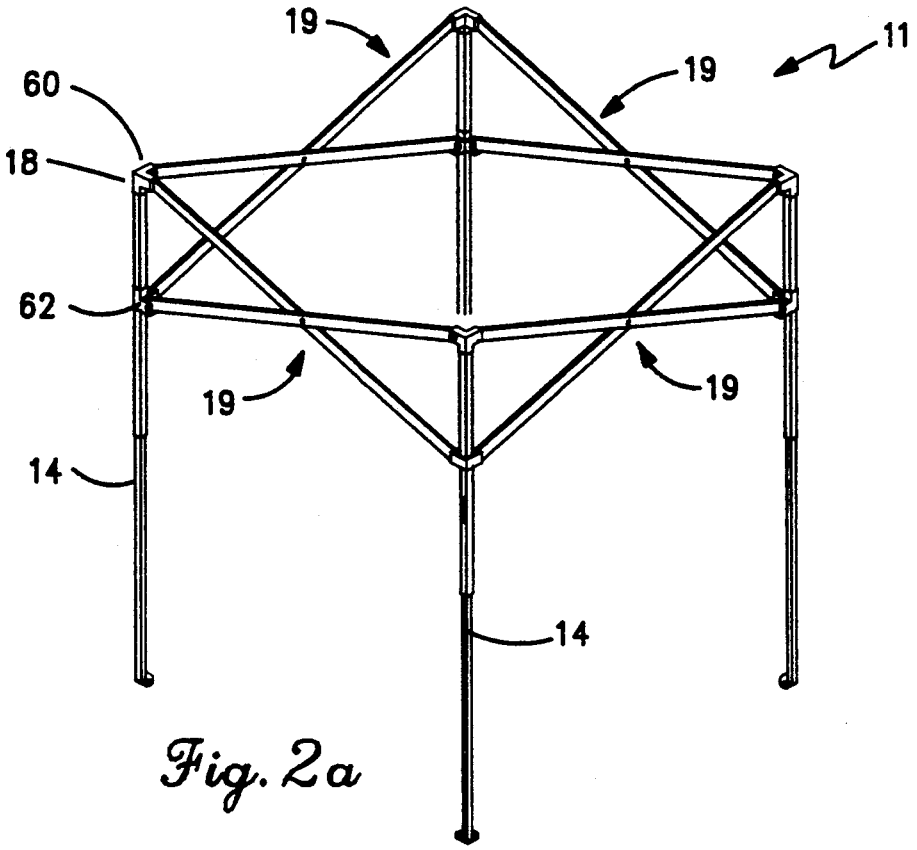
FIGS. 2(*a*), 2(*b*) and 2(*c*) show the framework assemblies used with the canopy units of FIGS. 1(*a*), 1(*b*) and 1(*c*), above.
Figure 2B:
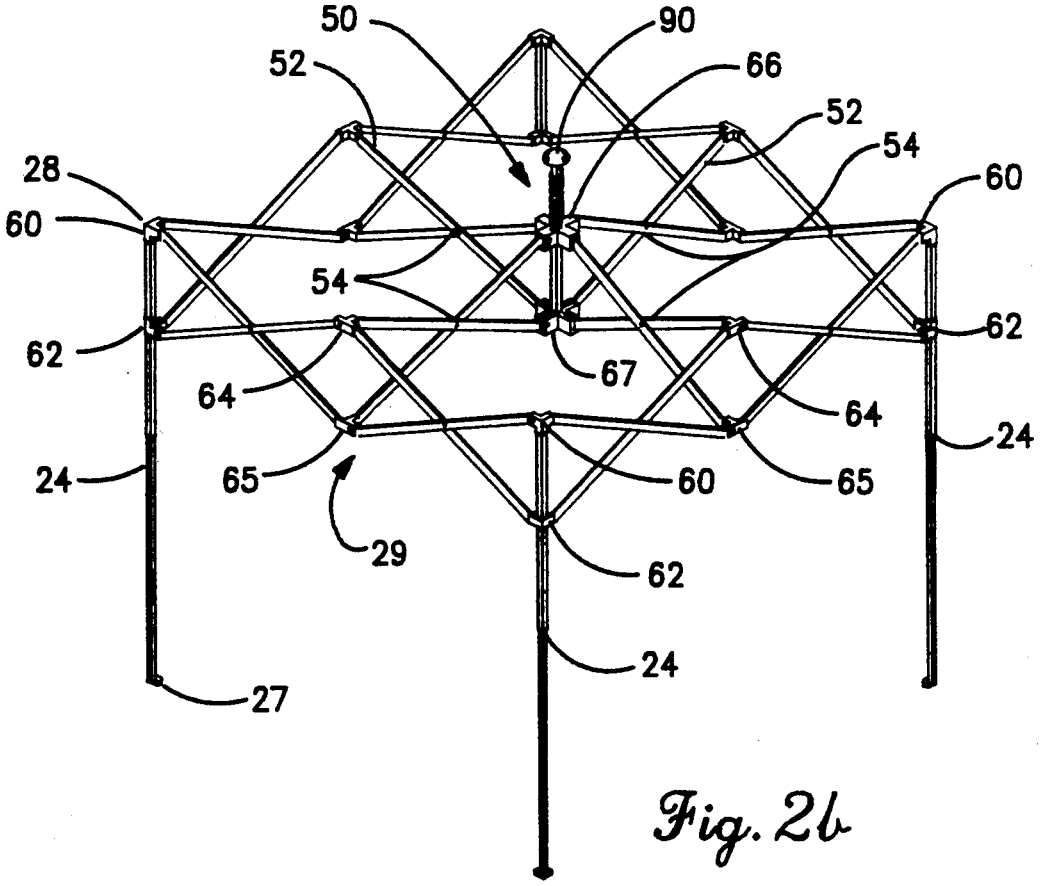
Figure 2C:
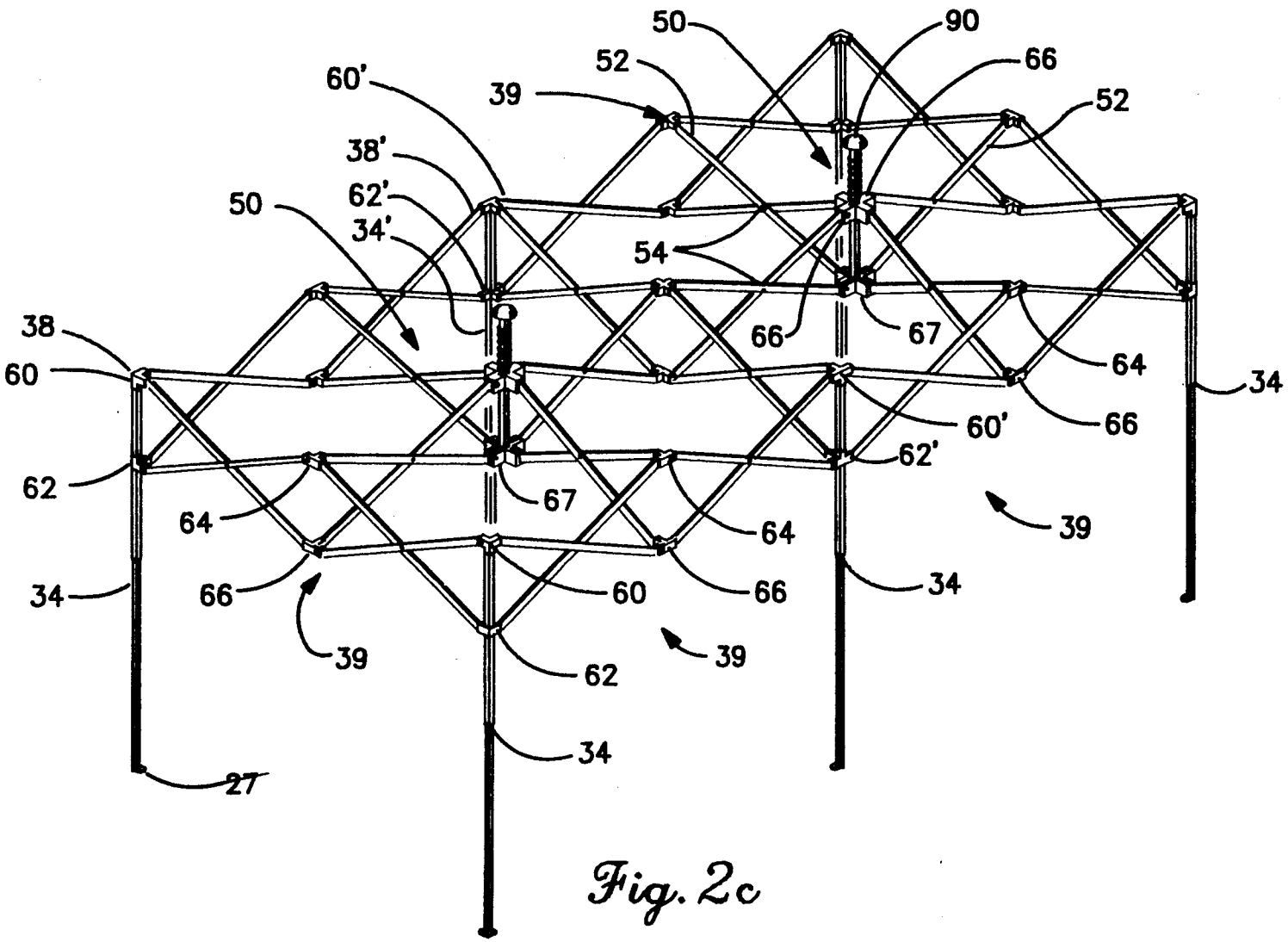
Figure 3:
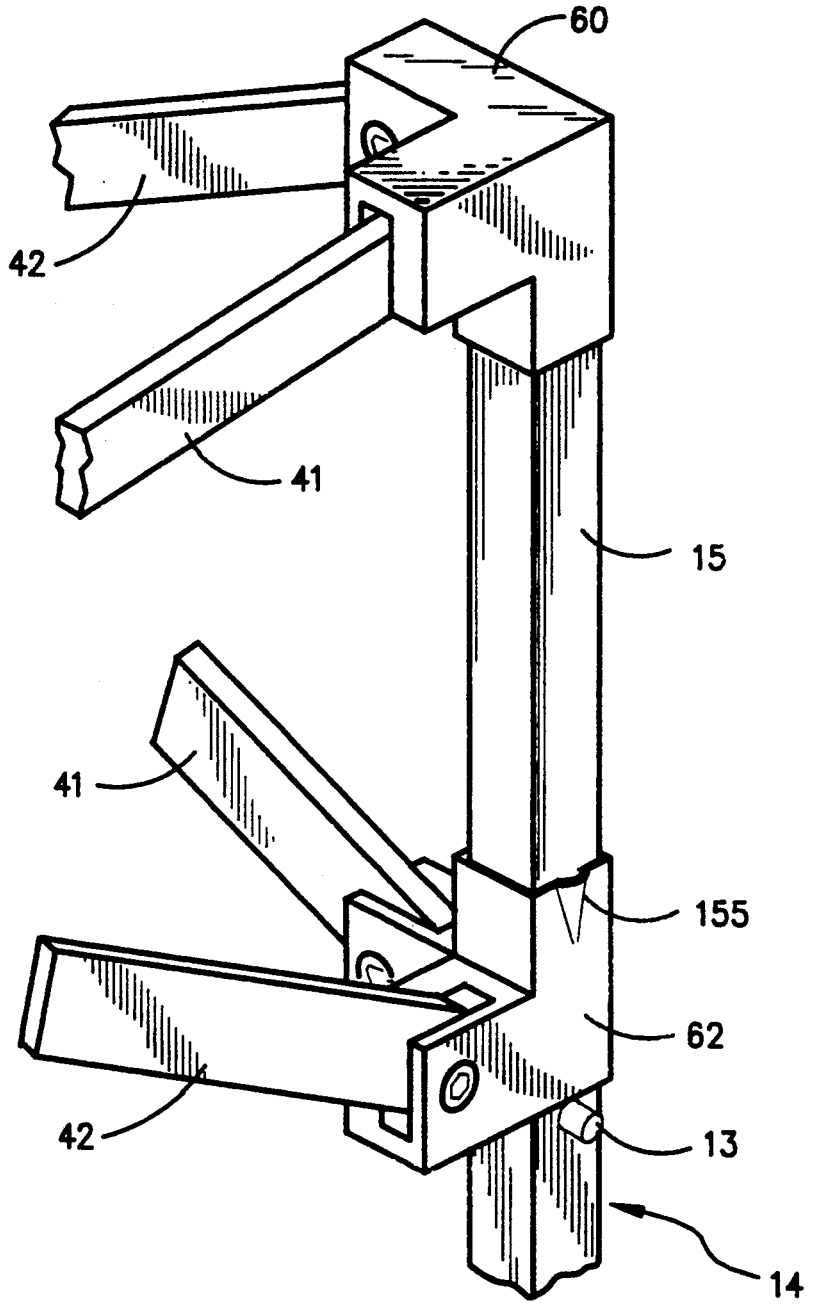
FIG. 3 is a perspective view of an upper end portion of a corner support member in the erected and latched state.

Turning to FIGS. 1(*a*)–1(*c*), FIGS. 2(*a*)–2(*c*) and FIG. 3 a framework structure used for temporary canopies are the type described in U.S. Pat. No. 4,641,676 as shown. In FIG. 1(*a*) and 2(*a*), a framework structure 11 is shown in an expanded state and supports a fabric covering 12 to produce canopy unit 10. Framework structure 11 is formed by four upright support members in the form of upright corner support members 14 each of which comprises a pair of telescoping structures such as upper leg section 15 into which lower leg section 16 is slideable received. Each upright support member 14 has a lower end 17 which engages or rests on a support surface and an upper end 18 opposite lower end 17. A stationary mount 60 according to the exemplary embodiment of the present invention is disposed at each upper end 18. A slide mount 62 is slideably received on upper leg section 15 so that each slide mount 62 may move from a position remote from a respective stationary mount 15 to a location proximate stationary mount 60 as shown in FIG. 2(*a*). When located proximately stationary mount 60, as shown in FIG. 2(*a*) and FIG. 3, each mount 62 may be latched into position by a suitable latch structure such as depressable button latch 13. Each upright support member 14 is interconnected to adjacent upright corner support members by means of a scissor assembly 19 which has opposite outer upper and lower ends captured in sockets formed in mounts 60 and 62 as described more thoroughly below.

Similarly, with respect to FIGS. 1(*b*) and 2(*b*), a canopy 20 is formed by means of framework structure 21 which supports a covering 22. Framework structure 21 has a plurality of upright support members 24 located at the corners thereof. Each upright support member 24 has an upper led section 25 which telescopically receives a lower leg section 26, Lower ends 27 of upright support members 24 engage a support surface while upper ends 28 thereof are provided with stationary mounts 60. Scissor assemblies 29 interconnect adjacent ones of upright support members 24 and are formed by scissor units 40 connected end-to-end relation with one another by upper and lower floating mounts 64 and 65. Opposite outer upper ends of scissor assemblies 29 are fixed to mounts 60 while outer lower ends of scissor assemblies 29 are fixed to slide mounts 62 which are slideably received on upper leg sections 25. A roof support structure 50 includes internal scissor assemblies 52 in the form of scissor units 54 which are connected to one another and internal ends by upper and lower central mounts 66 and 67 and at their outer upper and lower ends by means of floating brackets 64, 65, all as described more thoroughly below. Central mounts 66 and 67 support a center post structure 90, again as described below.

Finally, with respect to FIGS. 1(*c*) and 2(*c*) it may be seen that canopy 30 is a larger area device having a framework 31 which supports a covering 32. Framework 31 has a plurality of upright support members in the form of corner support members 34 and intermediate support members 34' which respectively have upper leg sections 35, 35' into which lower leg sections 36, 36' are telescopically received. Lower ends 37, 37' engage a support surface while upper ends 38, 38' respectively mount stationary mounts 60, 60'. Slide mounts 62, 62' are slideably received on upper leg sections 35, 35', and adjacent upright support members 34, 34' are interconnected by means of scissor assemblies 39. A pair of roof support structures 50 interconnect facing scissor assemblies 39 which are facing one another. Each roof support structure 50 includes internal scissor assemblies such as scissor assemblies 52 and central post structure 90 having upper and lower central mounts 66 and 67 as described above with reference to FIG. 2(*b*).

Figure 4A:
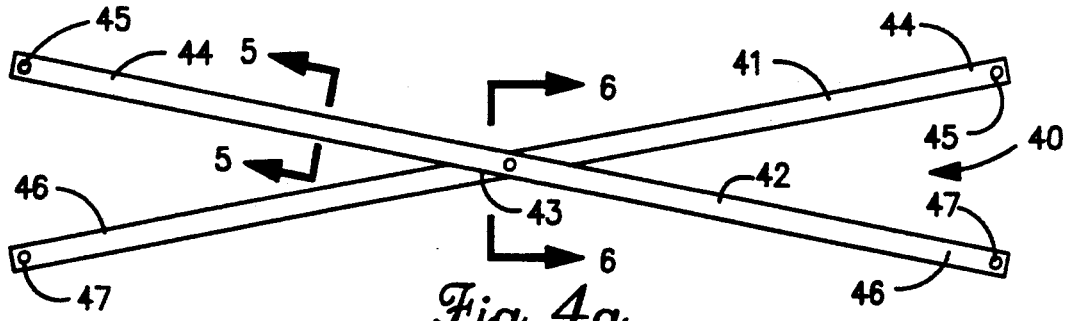
FIG. 4(*a*) is a side view in elevation showing a scissor unit according to the exemplary embodiment of the present invention and FIG. 4(*b*) is a side view in elevation showing two scissor units of FIG. 4(*a*) interconnected in end-to-end relation to form a resulting scissor or truss assembly.
Figure 4B:
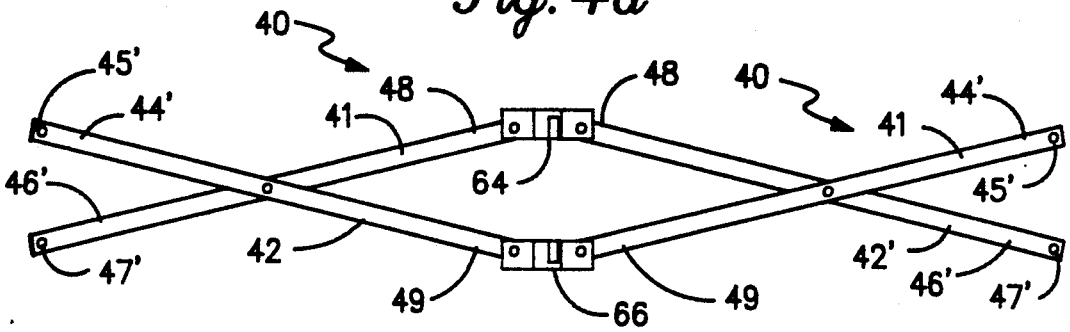

With reference to FIGS. 2(*a*) and 4(*a*), it may be seen that scissor assemblies 19 (FIG. 2(*a*)) is in the form of a single scissor unit 40 (FIG. 4(*a*)). Scissor unit 40 is constructed by a pair of scissor bars 41 and 42 which are pivotally joined to each other at a common central portion 43 thereof. Scissor unit 40 has a pair of outer upper end portions 44 which are provided with bores 45 therethrough, and a pair of outer lower end portions 46 which are provided with bores 47. As shown in FIG. 4(*b*) a pair of scissor units 40 may be joined together so that the resulting scissor assembly has outer upper end portions 44' and outer lower end portions 45' which are provided with bores 45' and 47', respectively. Internal upper end portions 48 are connected to one another by upper floating mounts 64 while lower internal end portions 49 of scissor units 40 are connected by means of lower floating mounts 66.

Figure 5:
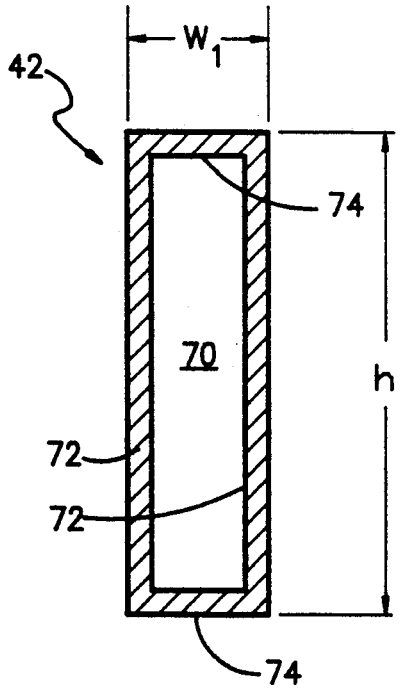
FIG. 5 is a cross-sectional view taken about lines 6—6 of FIG. 4(*a*)

Each of scissor bars 41 and 42 are preferably hollow, extruded aluminum tubular material having a rectangular cross section and are identical to one another. Alternately, scissor bars 40 may be made of any suitable construction material such as steel, plastic, fiberglass and the like. Thus, as shown in FIG. 5, for example, scissor bar 42 has a hollow interior 70 formed by sidewalls 72 and 74. Sidewalls 72 define a vertical dimension of height "h" for the scissor bar such as scissor bar 42 while sidewalls 74 defines a horizontal dimension or width "$w_1$".

Figure 6:
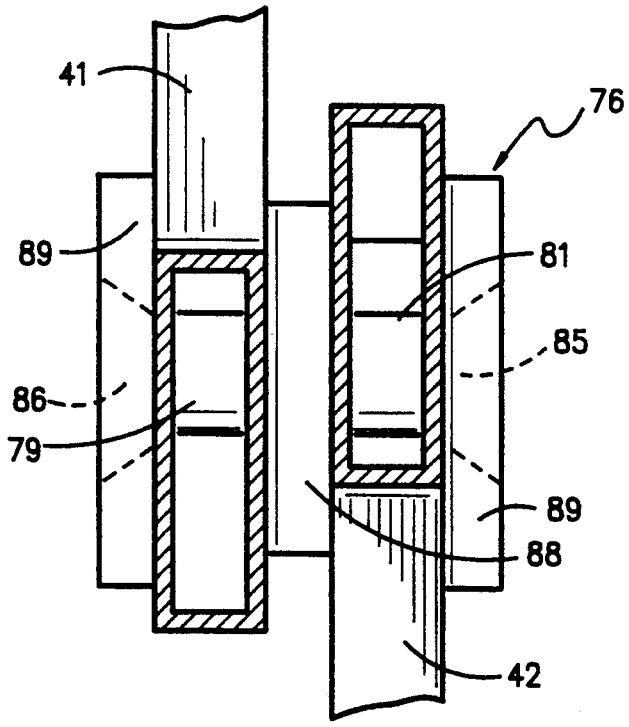
FIG. 6 is a cross-sectional view taken about lines 6—6 of FIG. 4(*a*)
Figure 7:
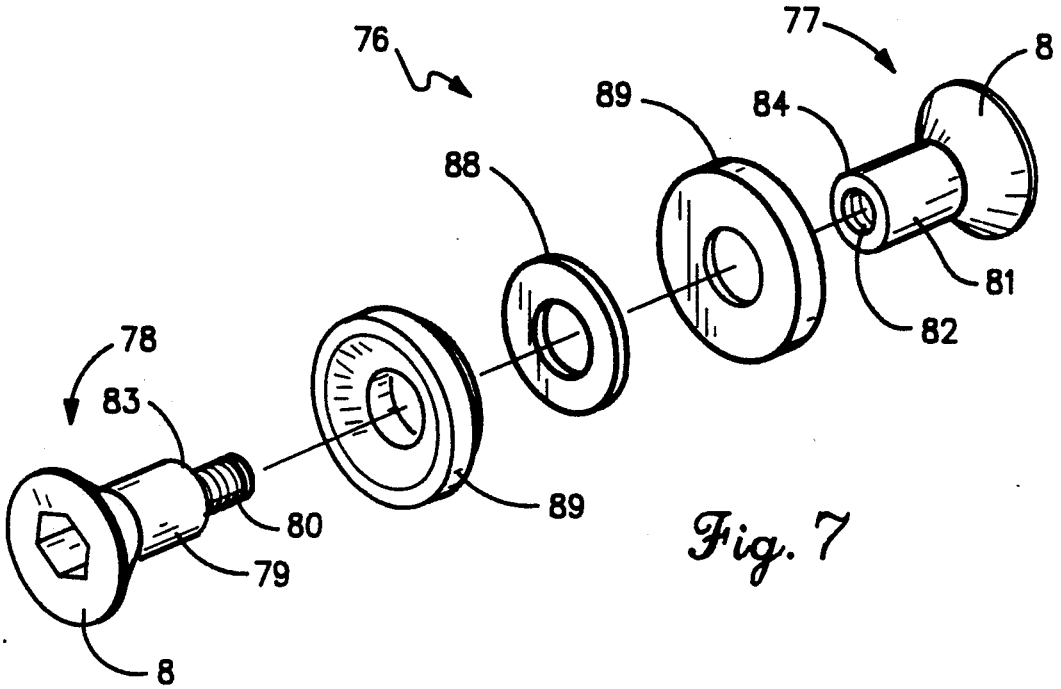
FIG. 7 is an exploded perspective view showing the connecting pin assembly used to interconnect a pair of scissor bars into a scissor unit shown in FIG. 4(*a*)

As noted above, scissor bars 41 and 42 are connected at common central portion 43. To this end, a pivot fastener structure 76 is provided as best shown in FIGS. 6 and 7. In these figures, pivot fastener structure 76 includes a pair of cooperative mating pivot fastener structures define a pivot axle that is a non-compressive element formed by a pair of cooperative axle pins such as female pin 77 and male pin 78. Male pin 78 has an elongated shaft 79 terminating in a threaded end 80 of reduced cross-section which, in turn, may be threadably received in threaded bore 82 of shaft 81 on female pin 77. When joined, shoulder 83 on shaft 79 abuts rim 84 on shaft 81 so that the respective heads 85 and 86 of female and male axle pins 77 and 78 have a minimum distance of separation defined by the lengths of shafts 79 and 81. The minimum distance for the spacing between heads 85 and 86, as shown in FIG. 6, is at least the combined cross-sectional widths of scissor bars 41 and 42. Further, heads 85 and 86 are preferably separated a minimum distance to accommodate a spacer washer 88 therebetween. Heads 84 and 85 are tapered, and countersunk washers 89 are preferably provided for mounting on the outermost sides of scissor bars 41 and 42, as shown in FIG. 6.

Figure 8:
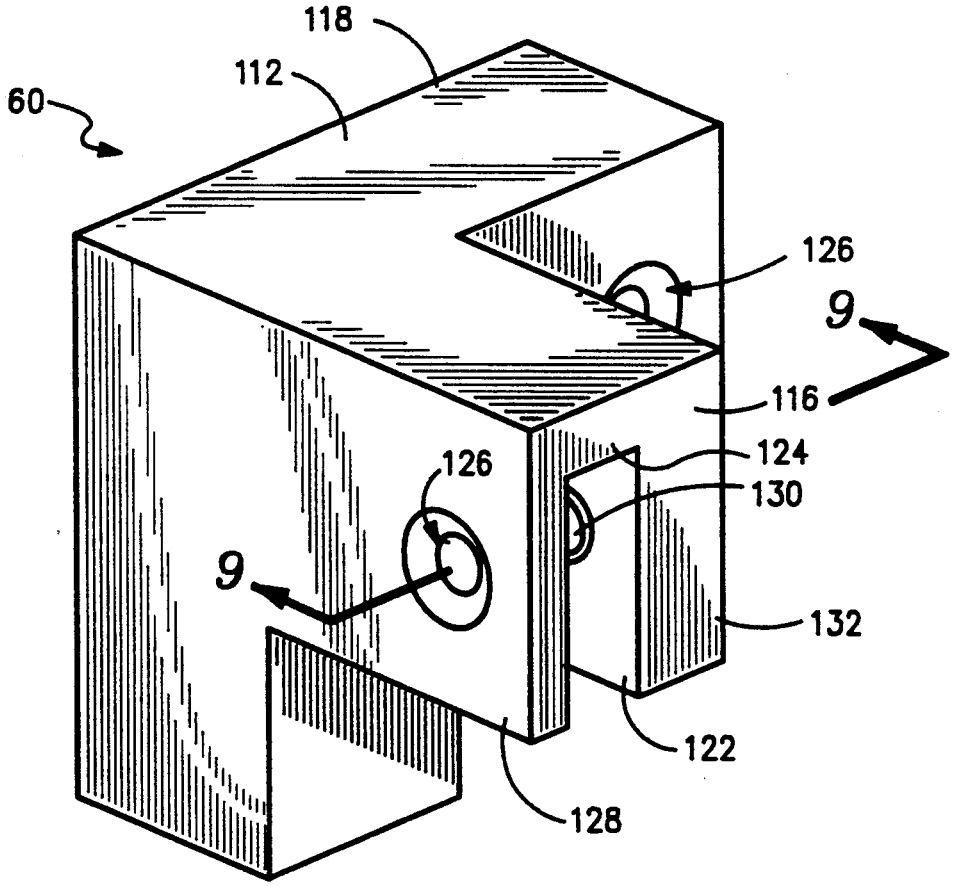
FIG. 8 is a perspective view of a stationary mount according to the exemplary embodiment of the present invention and used at the upper portion of a corner upright support.
Figure 9:
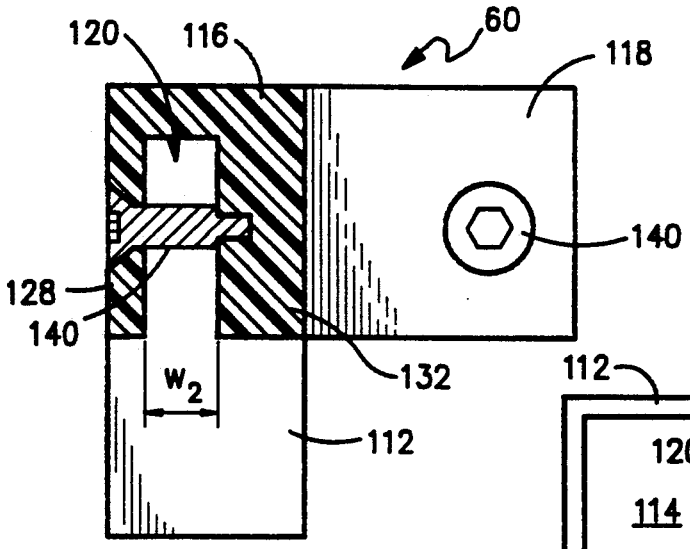
FIG. 9 is a cross-sectional view taken about lines 9—9 of FIG. 7 and with the axial pin mounted therein.
Figure 10:
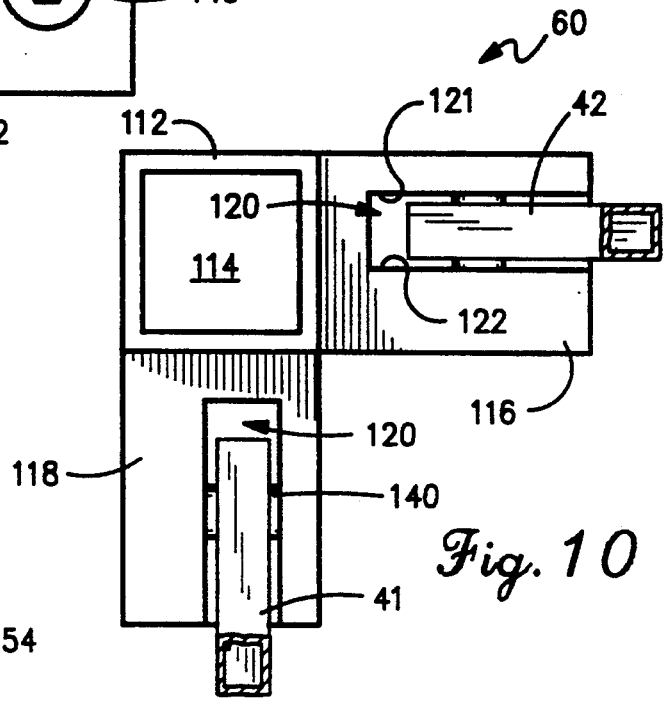
FIG. 10 is a bottom plan view of the stationary mount shown in FIGS. 8 and 9 having attached thereto two scissor elements of respective scissor assemblies.
Figure 11:
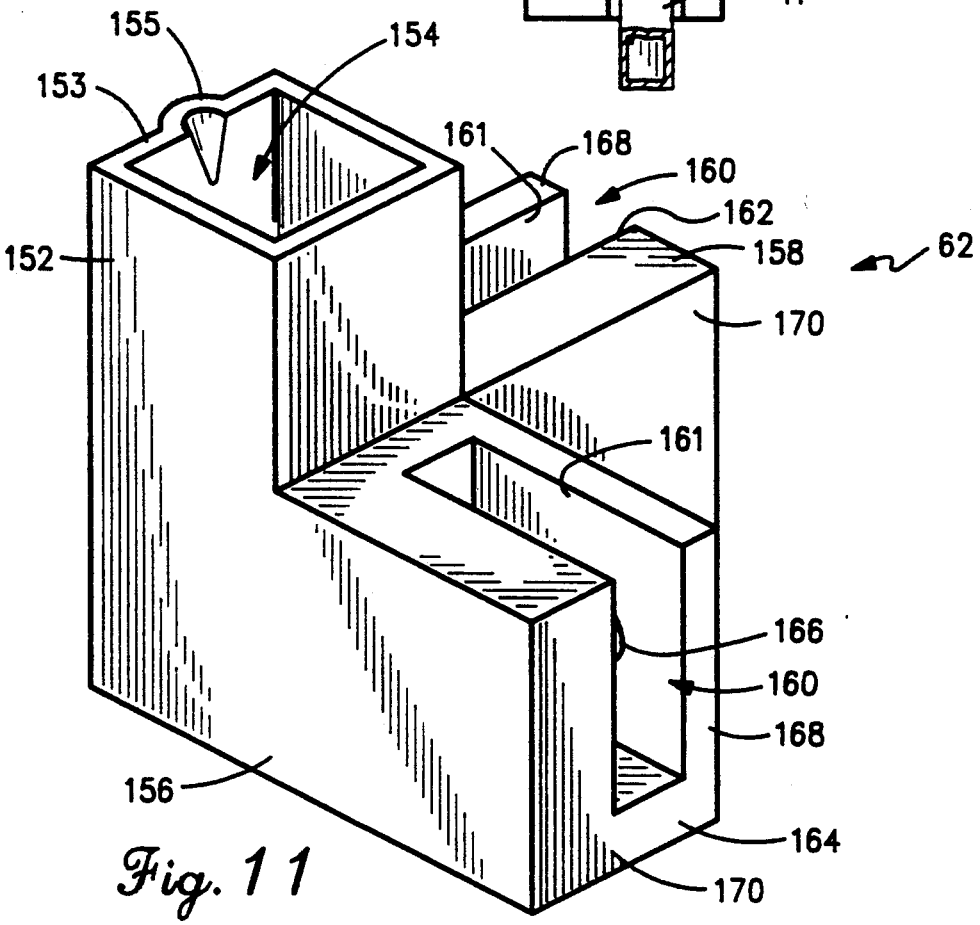
FIG. 11 is a perspective view of a slide mount according to the exemplary embodiment of the present invention.
Figure 12:
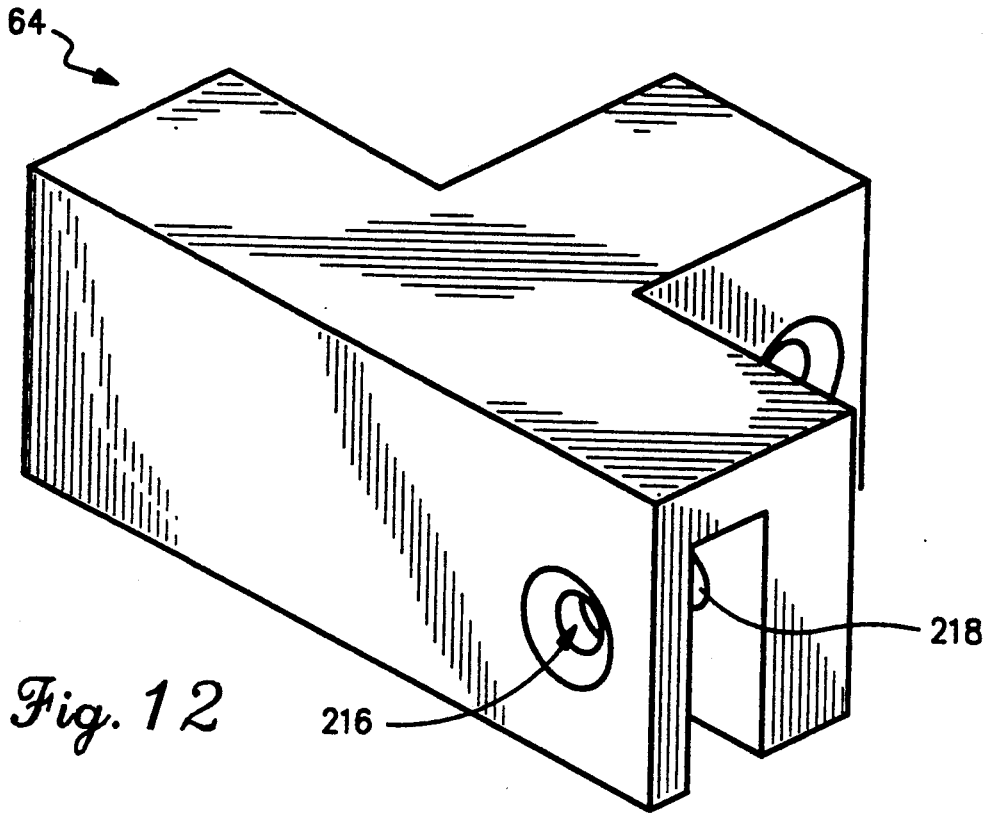
FIG. 12 is a perspective view of a floating mount according to the exemplary embodiment of the present invention.
Figure 13:
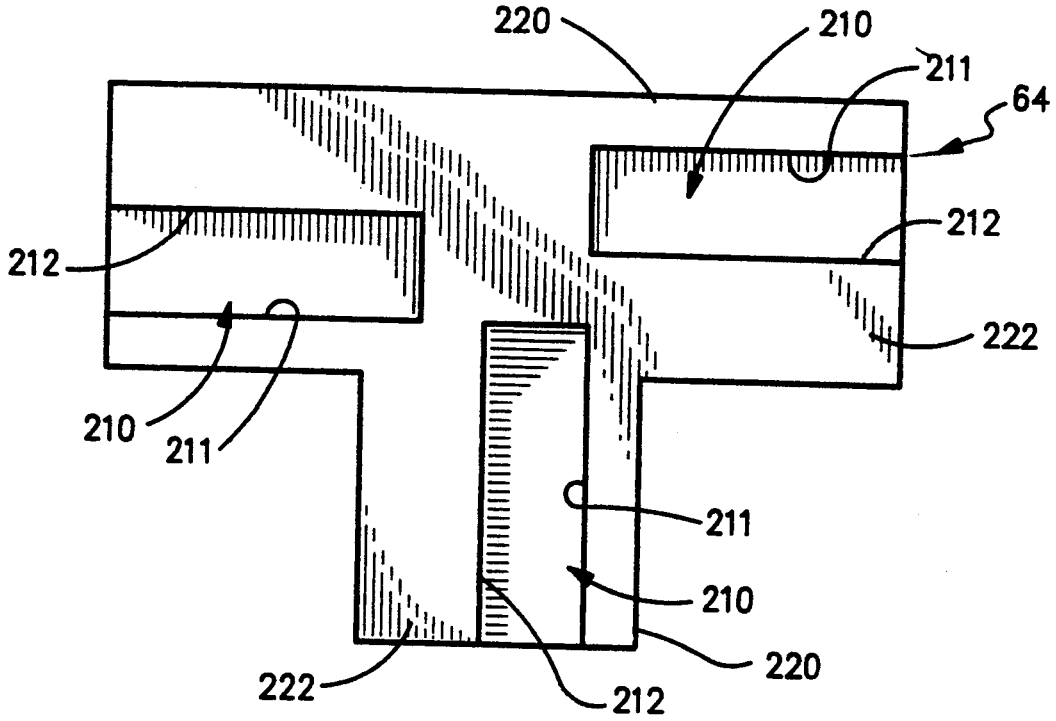
FIG. 13 is a bottom plan view of the floating mount shown in FIG. 12.
Figure 14:
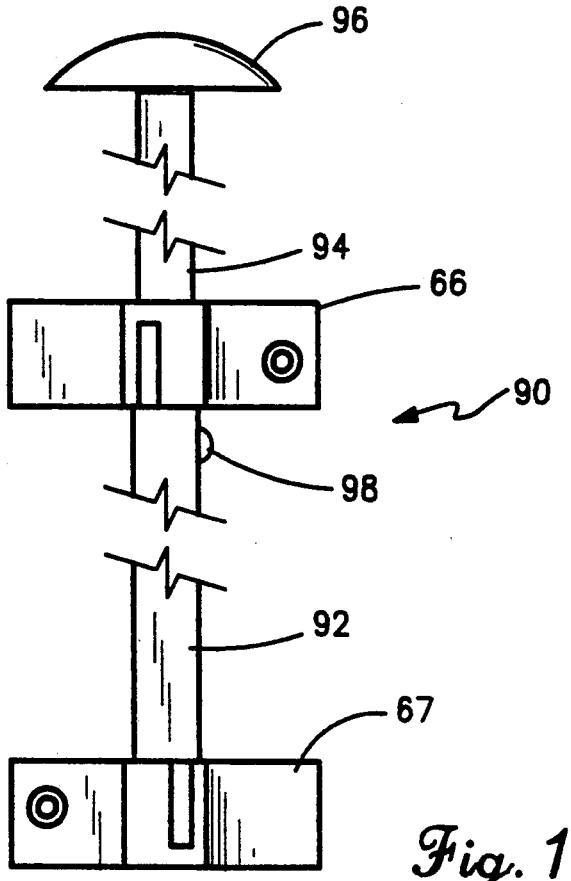
FIG. 14 is a side view in elevation showing a center post assembly according to the exemplary embodiment of the present invention.
Figure 15:
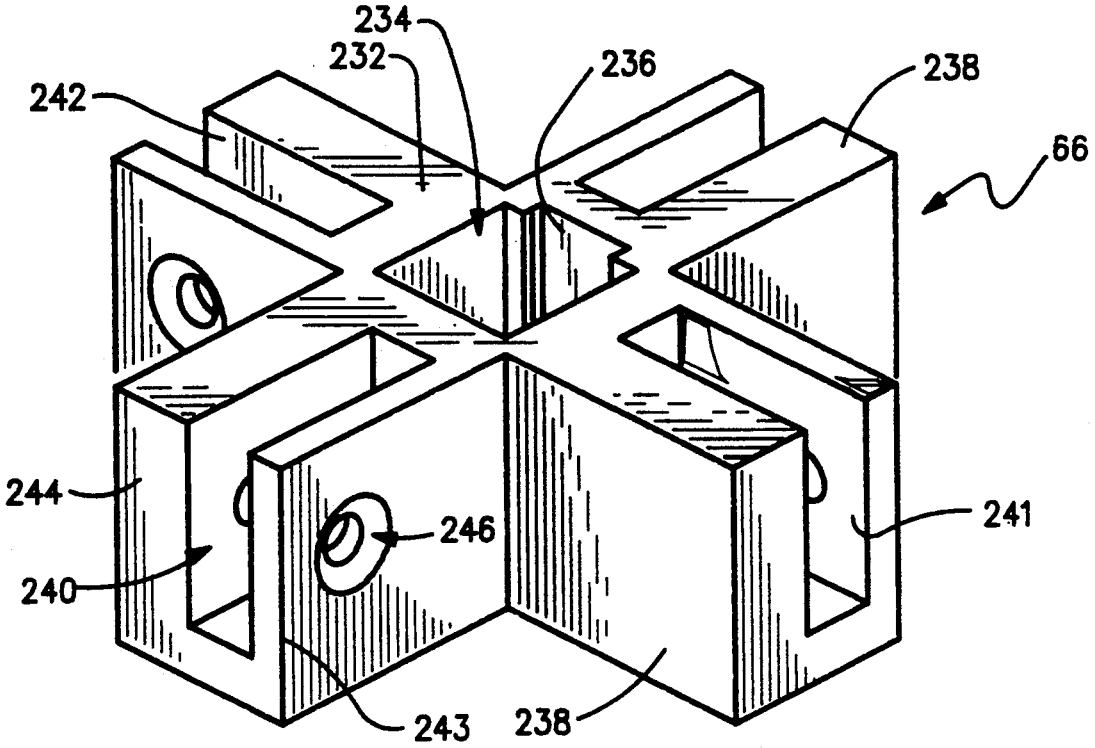
FIG. 15 is a perspective view of an upper center mount as shown in FIG. 14.

As noted in the introductory remarks of this application, the present invention particularly concerns novel mounts for connecting the scissor units 40, one to another, in end-to-end relation as well as to connect scissor assemblies in the form of either single or multiple scissor unit trusses to their respective upright supports. To this end, the exemplary embodiment of the present invention includes stationary mounts, as shown in FIGS. 8–10, slide mounts as shown in FIG. 11, floating mounts as shown in FIGS. 12 and 13, and upper and lower central mounts as shown in FIGS. 14 and 15, respectively. It may be seen in these figures that each of the respective mounts define junction elements having a plurality of socket openings which are adapted to receive end portions of respective scissor bars 41 and 42.

With reference to FIGS. 8–10, a stationary mount 60 is shown which has a central portion 112 having a cavity 114 formed therein. Cavity 114 is sized to matably receive an upper end portion of an upright support member, such as a corner support member 14, 24 or 34. A pair of lobes 116 and 118 project outwardly of central section 112 at right angles to one another. Each of lobes 116, 118 is provided with a channel shaped socket 120 formed between a pair of spaced-apart sidewalls 121 and 122. Sidewalls 121 and 122 are joined by means of a web 124 with sidewalls 121, 122 being spaced-apart a width "$W_2$" which is just slightly larger than the width "$W_1$" each scissor bar 41, 42. A countersunk bore 126 extends through narrow wall portion 128 of each lobe 116, 118. Countersunk bore 126 thus opens onto a sidewall 121. A threaded bore 130 is formed in a large wall portion 132 of each lobe 116, 118 and is co-axial with countersunk bore 126. Countersunk bore 126 and threaded bore 130 are sized to mount a fastening pin in the form of axial pin 140 which is identical in structure to male pin 78, discussed above. Thus, pins 78 and pins 140 are interchangeable with one another which greatly simplifies construction of the framework assembly. Axial pins 140 serve to pivotally fasten respective scissor bars 41, 42 at outer upper end portions such as upper end portions 44, 44' through respective bores 45, 45' (shown in FIGS. 4(*a*) and 4(*b*)). The end portions of the respective scissor bars 41 and 42, as is shown in FIG. 10, are sized for close fitted mated engagement in sockets 120 for relatively free pivotal motion therein. Due to this close fitted construction, sidewalls 121 and 122 form planar contact surfaces with each respective scissor bar 41, 42, as is shown in FIG. 10, and, thus, resist lateral and torsional deflections of their respective scissor bars 41, 42 along the planar contact surfaces.

A slide mount 62 is best shown in FIG. 11 where it may be seen at slide mount 62 has a central section 152 defining a square shaped passageway 154 extending therethrough. An upper leg section of an upright support member may be telescopically received through passageway 154 so that slide mount 62 may readily slide therealong. A pair of lobes 156 and 158 project outwardly from central section 152 at right angles to one another. Each of lobes 156 and 158 include a small wall portion 168 and a large wall portion 170 which are connected to one another by means of a web 164. Channel shaped sockets 160 are formed in each of lobes 116, 118 between a pair of parallel spaced-apart, facing sidewalls 161 and 162. Small wall portion 168 is again provided with a countersunk bore, such as bore 166, and large wall portion 130 is provided with a co-axially formed threaded bore similar to bore 130. Sockets 160 are again sized to matably receive outer lower end portions of the respective scissor assemblies for pivotal mounting therein by means of a axial fastening pin, such as pin 140. It may be seen in FIG. 11 that central section 152 has an upper rim 153 provided with a lip structure 155 which defines a ramp so that, when slide mount 62 is slid from a location remote from stationary mount 60, lip structure 155 will slide over and depress button latch 13.

Since it is often desired that a scissor assembly be formed to have edge scissor assemblies comprising a plurality of scissor units forming truss cells, it is necessary to connect these scissor units in an end-to-end relation. Accordingly, as noted above, floating mounts 64 and 65 are provided. These mounts are identical to one another so that, as shown in FIGS. 12 and 13, a representative floating mount 64 is formed by a plurality of lobes 204, 206 and 208. Each of these lobes is provided with a channel shaped socket 210 having spaced-apart parallel sidewalls 211 and 212. Sidewall 211 is formed on the interior of small wall portion 220 while sidewall 212 is formed on the interior of large wall portion 222. Countersunk bores, such as bore 216 are provided through small wall portions 220 while an axially aligned threaded bore 218 is formed in large wall portions 222. Floating mounts 220 are thus defined T-shaped connectors which join a pair of scissor units 40 together and also provide a socket mount for the outer upper and lower end portions of the internal scissor assemblies, such as scissor assemblies 52 shown in FIGS. 2(*b*) and 2(*c*).

As briefly noted above, each of roof support structures 50 not only include internal scissor assemblies 52 but also a central post structure 90, best shown in FIG. 14. Central post structure 90 includes a sleeve 92 which telescopically receives a spring loaded roof support post 94 that terminates in a distal end in a domed cap 96. Sleeve 92 extends between upper and lower central mounts 66 and 67 with mounts 66 and 67 best being shown in FIGS. 14 and 15. It should be appreciated with reference to FIGS. 2(*b*), 2(*c*) and 13 that central post structure 90 interconnects a group of internal scissor units 54 at the upper and lower internal ends thereof. With reference to FIG. 2(*c*) it may be seen that additional central upper and lower central mounts 68 and 69 are provided to connect internal scissor units 52 at locations that are not provides with a central support post structure 90.

Turning to FIG. 15, it may be seen that upper central mount 66 has a central section 232 through which extends a passageway 234 provided with a keyway 236 sized to accommodate spring loading elements such as a post 98 shown in FIG. 14. Passageway 234 is sized to slideably receive sleeve 92 and a plurality of lobes 238 project outwardly from central section 232 at 90° angles with respect to one another. Each lobe 238 has a socket 240 formed therein between parallel spaced-apart facing sidewalls 241 and 242 formed between small wall portion 243 and large wall portion 244. Countersunk bores 246 are again provided to mate with corresponding threaded bores operative to receive a fastening pin forming a pivotal axle for scissor bar elements, such as scissor bar elements 41 and 42 which may be matably received in each of sockets 240 to form planar contact surfaces therebetween.

Figure 16:
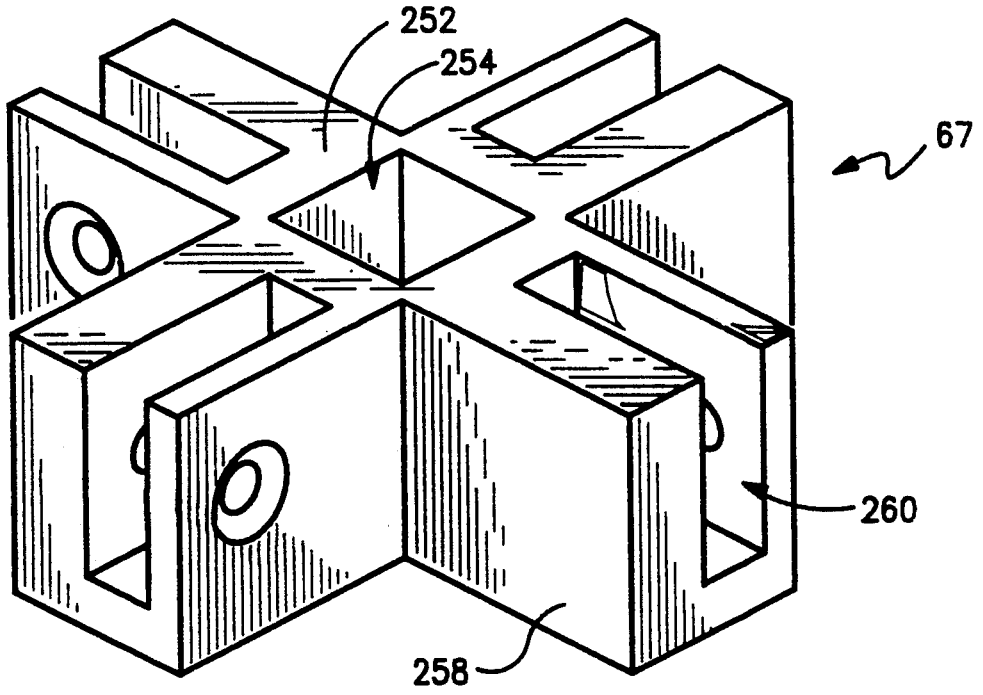
FIG. 16 is a perspective view of a lower center mount as shown in FIG. 14.

Similarly, lower central mount 67, shown in FIG. 16, includes a central section 252 provided with a passageway 254 extending therethrough. A plurality of lobes 258 project outwardly from central section 252 and are provided with sockets 260 of the type described with reference to FIG. 15 above, which is also the same general construction described with respect to stationary mount 60, slide mount 62 and floating mount 64. Accordingly, it is believed that this structure will now be readily understood by the ordinarily skilled person in this art so that further description is not believed necessary to describe the structure shown in FIG. 16. It should be also noted with reference again to FIG. 2(*c*), that central mounts 68 and 69 are substantially identical to central mounts 66 and 67 with the exception of the elimination of passageways 234 and 254 and the sizing of such mounts to accommodate the scissoring action when the framework structure is moved between the collapsed and expanded states.

Figure 18:
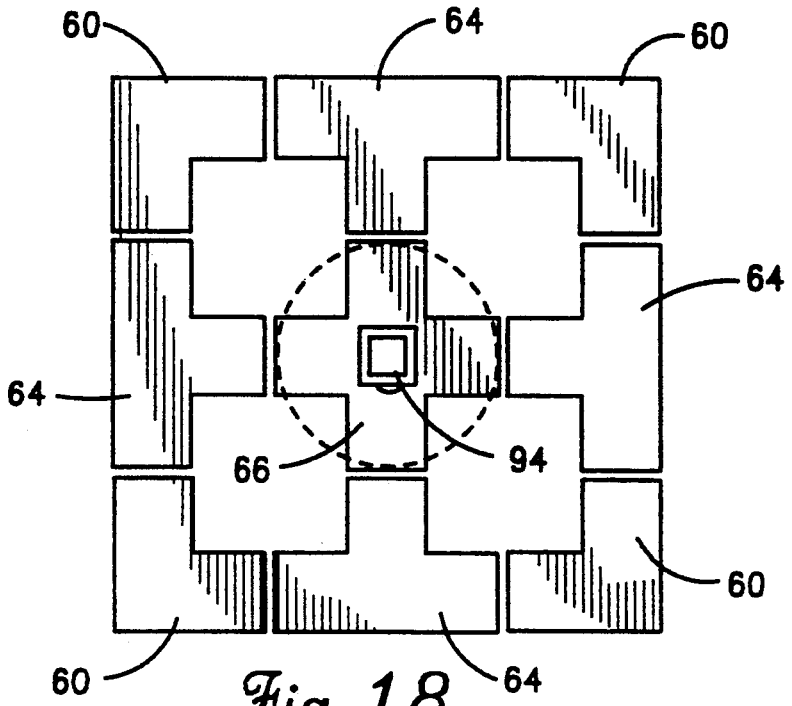
FIG. 18 is a top plan of the collapsed canopy framework of FIG. 17 but with the center post shown in phantom.
Figure 17:
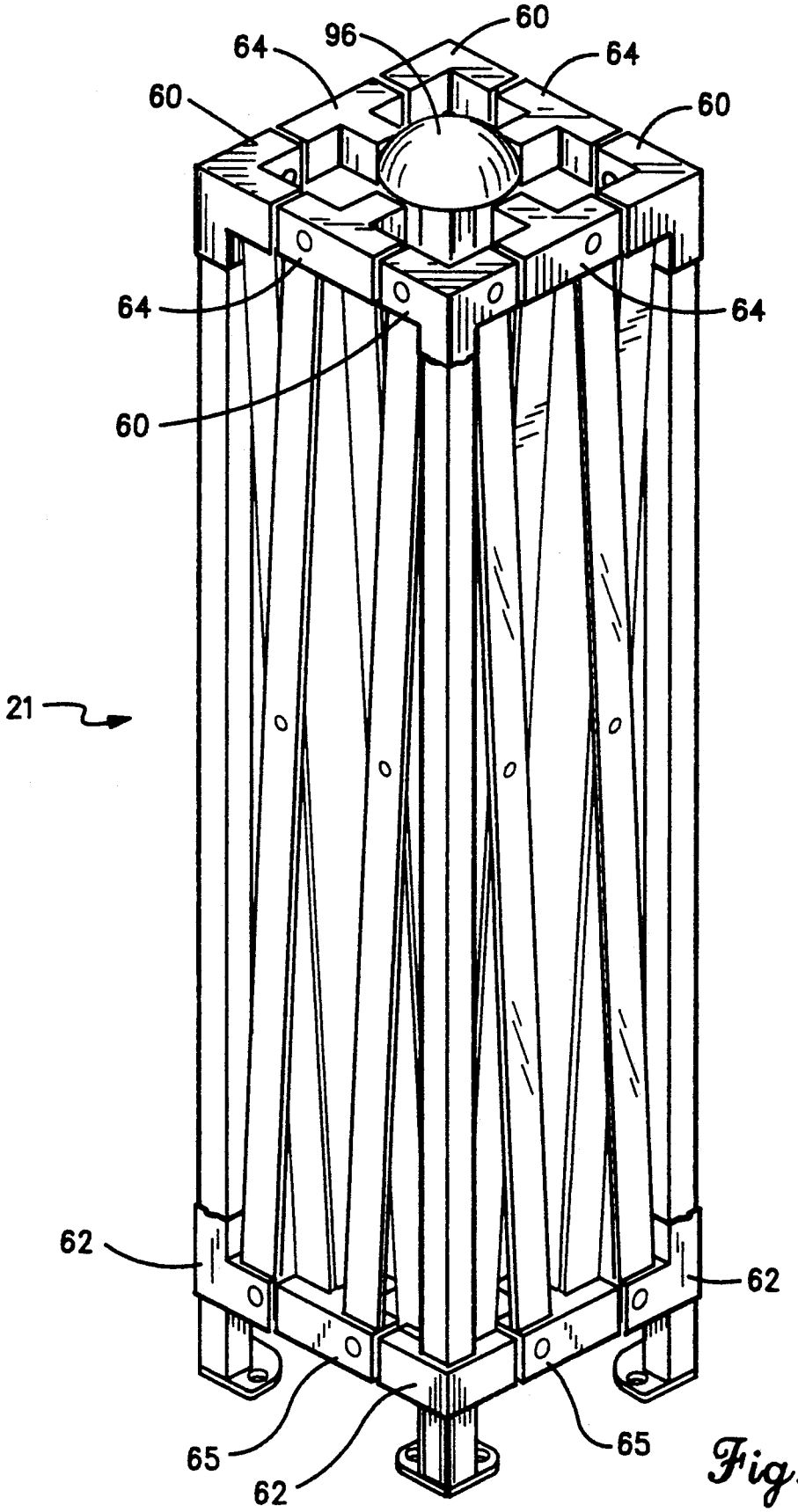
FIG. 17 is a perspective view showing a fully collapsed canopy framework of a type shown in FIG. 2(*b*)

Another advantage of various mounts described above may now be appreciated with reference to FIGS. 17 and 18 wherein a representative framework structure 21 is shown in the collapsed state for storage. In this orientation, the various scissor bars and corner support upright supports are oriented alongside one another with lower leg sections 16 being received in upper leg sections 15. In the collapsed state, a stationary mounts 60 along with upper floating mounts 64 form an uninterrupted rim surrounding the upper end portion of the framework unit in the collapsed state. Upper central mount 66 is sized and nested within the this rim. Likewise, slide mounts 62 and lower floating mounts 65 form a relatively uninterrupted rim around an opposite end portion of the framework unit in the collapsed state. While not shown, it should be understood that lower central mount 67 would be nested within this resulting lower rim in a manner similar to that shown with respect to the upper rim of FIG. 18. The protective rim formed by the various mounts acts to resist damage to the ends of the scissor units when the framework structure is collapsed and stored.

Figure 19:
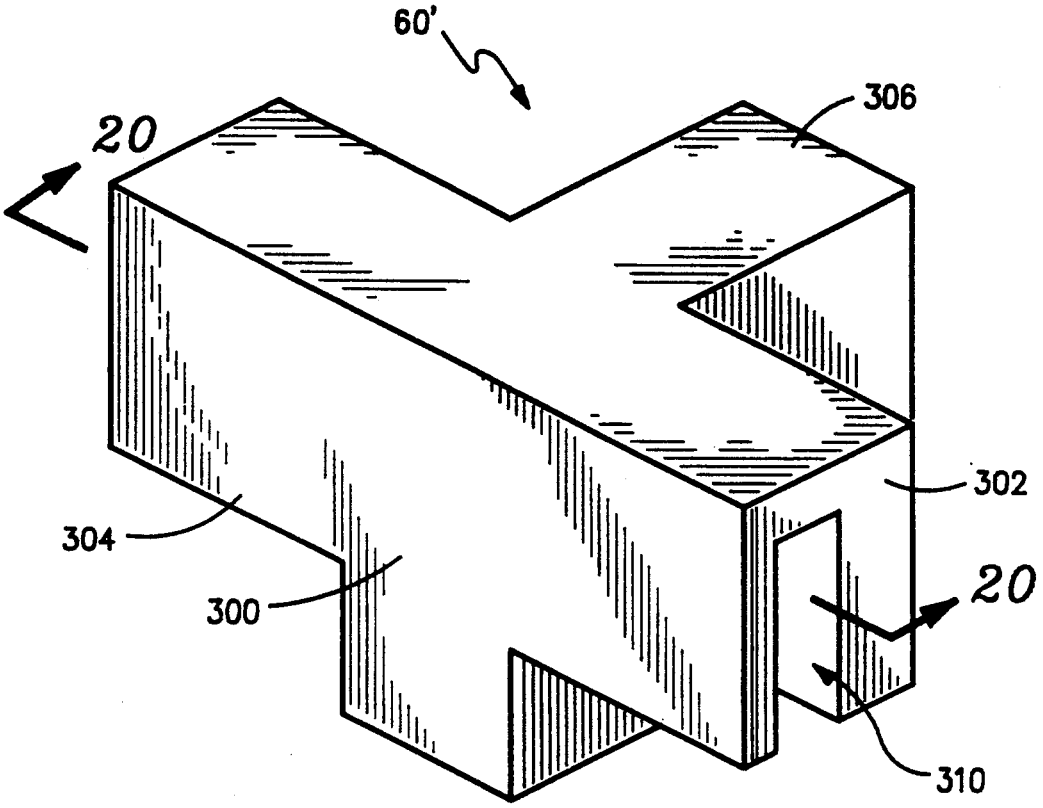
FIG. 19 is a perspective view of an intermediate support stationary mount according to the exemplary embodiment of the present invention.
Figure 20:
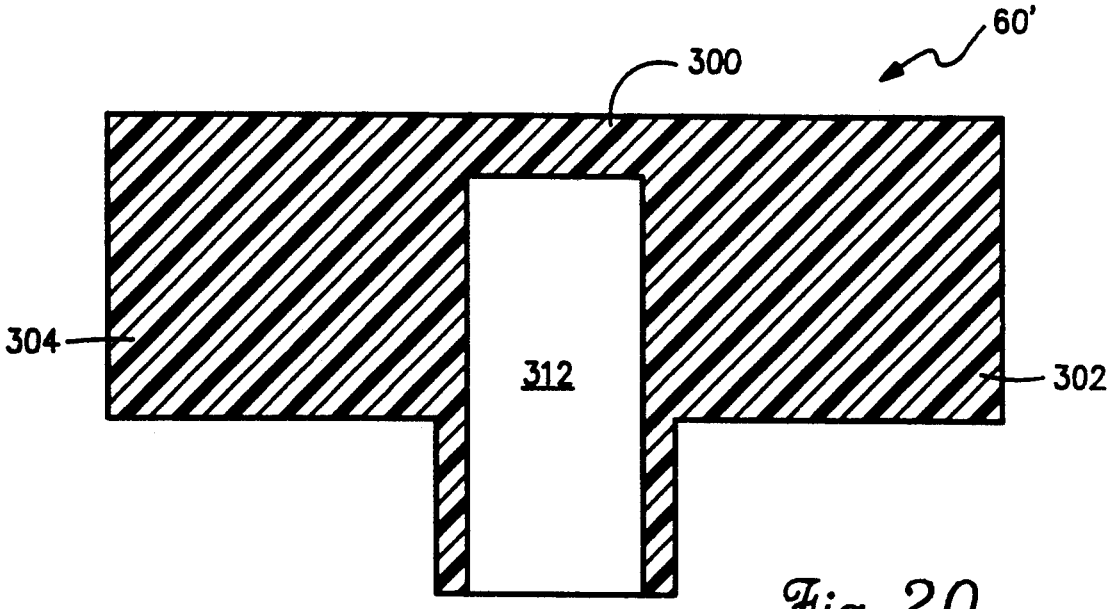
FIG. 20 is a cross-sectional view taken about lines 20—20 of FIG. 19.
Figure 21:
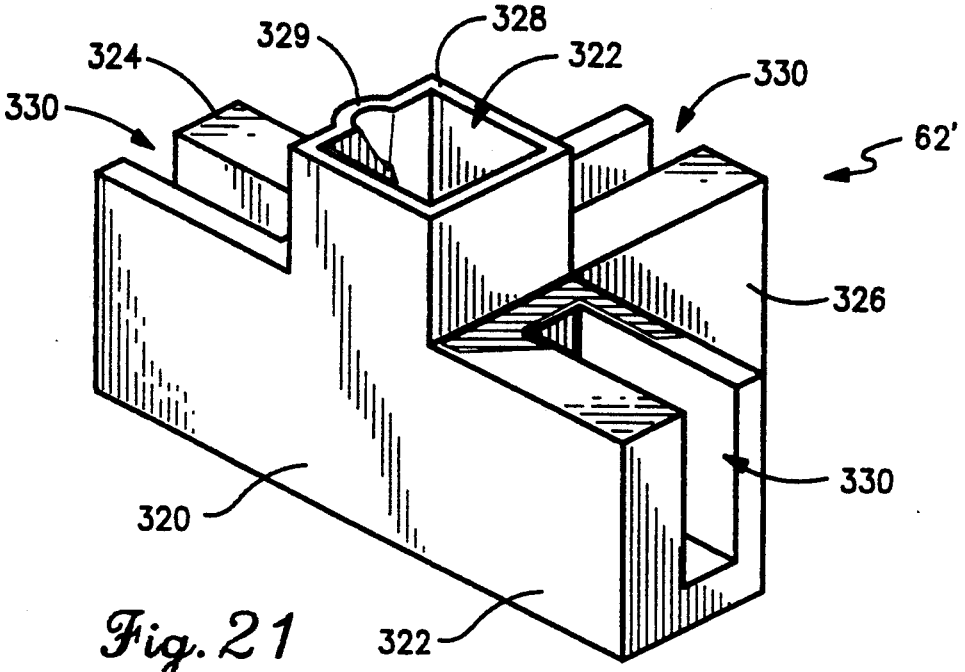
FIG. 21 is a perspective view of an intermediate sliding mount according to the exemplary embodiment of the present invention.

When the framework structure similar to FIG. 2(*c*) is employed, certain ones of the upright support members are located intermediate of the corner support members. Thus, as is shown in the Figure, intermediate upright supports 34' are provided and include stationary mounts 60' and slide mounts 62'. These respective mounts are shown in FIGS. 19–21. In FIGS. 19 and 20, stationary mount 60' has a central section 300 from which project three lobes 302, 304 and 306. Lobes 302 and 304 are aligned but project oppositely of one another while lobe 306 projects perpendicularly thereto. Each of lobes 302, 304 and 306 are formed similarly to the various lobes described above and have sockets 310 formed therein. Accordingly, it is not believed necessary to repeat the description. A central cavity 312 is provided to matably receive an upper end of upright support 34'. Likewise, slide bracket 62', shown in FIG. 21, is similar to slide bracket 52 but includes three lobes 322, 324 and 326 projecting outwardly from a central section 320. Passageway 322 is formed through central section 320 so that slide mount 62 may slide along upper leg section 35' of intermediate upright support 34'. In order to accommodate the respective button latch on intermediate upright support 34', a ramp structure is provided in the form of lip 329 on rim 328 of central section 320. Each of lobes 322, 324 and 326 are provided with sockets 330 which received the end portions of the respective scissor units for pivotal motion therein. Again, this structure has been described above.

Figure 22A:
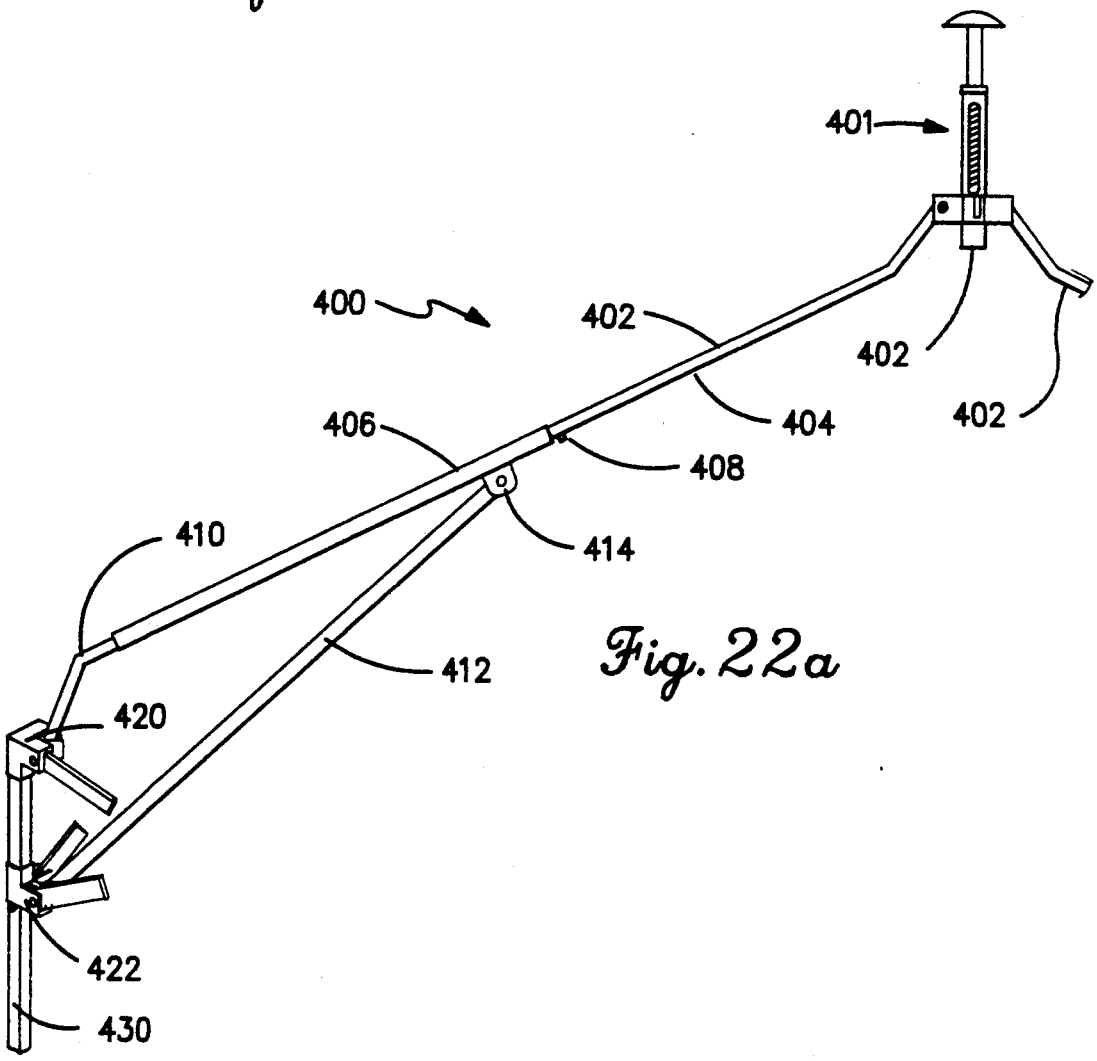
FIGS. 22(*a*) and 22(*b*) are side views in elevation showing first and second alternate embodiments of roof support structures which may be employed with the exemplary embodiments of the present invention.

Alternate roof support structures are shown in FIG. 22(*a*) and 22(*b*) with these roof support structures correspondingly to the roof support structures disclosed in my above reference U.S. Pat. Nos. 4,779,635 and 4,947,884 so that a detailed description is not here again repeated. Rather, with respect to FIG. 22(*a*), it may be seen that the roof support structure 400 includes a central support post structure 401 from which a plurality of roof support members 402 radially extend. Central support post 401 thereby defines an apex for supporting the canopy covering. Each roof support member 402 is constructed as a pair of extendible sections 404 and 406 which may be latched by means of button latch 408 in the extended state. A distal end 410 of roof support member 402 is pivotally attached to a stationary mount 420 while a cantilever arm 412 extends from a pivot bracket 414 located centrally of roof support 402 to be pivotally connected to slide mount 422. Stationary mount 420 and slide mount 422 are received on an upright support member 430 with slide bracket 422 being slideable therealong.

In FIG. 22(*b*), a roof support structure 500 includes central post assembly 501 from which radially extend a plurality of roof support members 502. Here, however, roof support members 502 terminate at a distal end that is directly connected to a slide mount, such as slide mount 522 which is slideably received on upright support member 530. A stationary mount 520 is located at the upper end of upright support member 530. The modifications to the socket mounts used in FIGS. 22(*a*) and 22(*b*) are shown in FIGS. 23 and 24. Stationary mount 420 is shown in FIG. 23 and is identical to mount 110 with the exception that a pair of spaced-apart walls 423 are provided to define a socket 424 which pivotally receives the distal end of roof support member 402. Roof support member 402 is thus pivotally secured by means of a suitable fastening pin 425.

In FIG. 24, slide bracket 422 is shown, and slide mount 422 is the same as slide mount 522. Each of these slide mounts are substantially the same as slide mount 150 shown in FIG. 11 but includes a pair of spaced-apart walls 433 which define a socket 434 therebetween to pivotally receive either a distal end of roof support member 502 or an outer end of cantilever arm 412 therebetween. To this end, fastening pine 435 is provided.

Finally, with reference to FIG. 25, it may be seen that the mounting lobes according to the exemplary embodiment of the present invention do not always have to be formed at right angles to one another. In FIG. 25, a stationary mount 600 is shown having a pair of lobes 602 which are oriented at 60° with respect to one another so that sockets 604 are likewise oriented at an angle of 60° with respect to one another. Stationary mount 600 includes a cavity 606 to receive the upper end portion of an upright support member and, it should be understood by the ordinarily skilled artisan that the resulting structure formed by mounts such as stationary mount 600 would be triangular in shape, similar to that shown in FIG. 9 of my U.S. Pat. No. 4,641,676. To this end, the corresponding slide mount for such structure would be configured similarly to the stationary mount of FIG. 25 but a continuous slide passageway would extend through the slide mount in place of cavity 606.

Accordingly, the present invention has been described with some degree of particularly directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. An expandable framework structure adapted to be folded and stored in a collapsed state and erected in an expanded state on a support surface whereby said framework structure may support a canopy covering above said support surface, comprising:

(a) a plurality of upright support members each having a bottom end positionable on the support surface and a top end opposite said bottom end, said support members oriented alongside one another in the collapsed state and movable outwardly apart from one another toward the expanded state;

(b) a plurality of edge scissor assemblies with there being an edge scissor assembly interconnecting adjacent ones of said support members, each said edge scissor assembly having a pair of outer upper ends and a pair of outer lower ends, said edge scissor assemblies operative to open and close whereby said framework structure may move between the expanded and contracted states;

(c) plurality of mounts disposed on said upright supports and operative to fasten said edge scissor assemblies thereto, said mounts each having sockets formed therein by spaced-apart, parallel sidewall portions, said edge scissor assemblies each having outer end portions of rectangular cross-section received in a respective one of said sockets in a close-fitted engagement between the parallel facing sidewall portions thereof thereby forming planar contact surfaces with said parallel sidewall portions; and (d) a fastening pin pivotally securing each outer end of said edge scissor assemblies in the respective socket, said mounts being relatively movable with respect to one another to allow said edge scissor assemblies to open and close as said framework structure expands and contracts while the parallel sidewalls of the sockets may act on the outer end portions along the planar contact surfaces to resist lateral and torsional deflections of said edge scissor assemblies.

2. An expandable framework structure according to claim 1 wherein a pair of said mounts are disposed on each of said upright support members, one of said pair being a stationary mount and another of said pair being a slide mount, said slide mount slideably secured to said upright support member and movable therealong between locations proximate to and remote from said stationary mount when the respective said edge scissor assembly opens and closes.

3. An expandable framework structure according to claim 2 including latch means associated with said upright support members for releasably latching the respective said slide mount in the position proximate its respective said stationary mount.

4. An expandable framework structure according to claim 2 including a roof support assembly supported above the support surface by said upright support members when in the expanded state, said roof support assembly operative to support said canopy covering.

5. An expandable framework structure according to claim 4 wherein said roof support assembly includes a plurality of roof support members pivotally connected to one another at proximal ends thereof to form an apex and extending radially outwardly from one another when in the expanded state, each roof support member pivotally connected at a distal end thereof to one of said mounts on a respective upright support member.

6. An expandable framework structure according to claim 5 wherein each said roof support member includes a pair of extendible sections movable between a retracted state when said framework structure is in the collapsed state and an extended state when said framework structure is in the expanded state and including roof support member latch means for releasably retaining said extendible sections in the extended state.

7. An expandable framework structure according to claim 5 wherein a pair of said mounts are disposed on each of said upright support members, one of said pair being a stationary mount and another of said pair being a slide mount, said slide mount slideably secured to said upright support member and movable therealong between locations proximate to and remote from said stationary mount when the respective said edge scissor assembly opens and closes and wherein each said roof support member is pivotally connected to a respective stationary mount and including a cantilever section pivotally connected at a first cantilever end to one of said extendible sections and at a second cantilever end opposite said first cantilever end to the slide mount on the respective said corner support member.

8. An expandable framework structure according to claim 1 wherein each said edge scissor assembly includes a pair of scissor units connected at upper and lower inner ends thereof in end-to-end relation, each said edge scissor assembly including an upper floating mount and a lower floating mount operative respectively to pivotally connect upper and lower inner end portions of the respective scissor units, each said upper and lower floating mounts having a plurality of sockets formed therein by spaced-apart, parallel sidewall portions, the inner ends of said scissor units each having a rectangular cross-section that is received in a respective one of said sockets in close-fitted engagement between the facing sidewalls portions thereof and including a fastening pin pivotally securing each inner end of said scissor units in the respective socket while the parallel sidewalls of the sockets resist lateral and torsional deflections of said scissor units.

9. An expandable framework structure according to claim 8 including a roof support assembly assembly supported above the support surface by said upright support members when in the expanded state, said roof support assembly operative to support said canopy covering.

10. An expandable framework structure according to claim 9 wherein said roof support assembly includes an internal scissor assembly extending between and connected to at least one pair of acing edge scissor assemblies and operative to expand and contract in response to expansion and contraction of said one pair of facing edge scissor assemblies, said internal scissor assembly having internal scissor upper and lower outer ends of rectangular cross-section received in respective sockets respectively formed in said upper and lower floating mounts and pivotally fastened therein by respective said fastening pins.

11. An expandable framework structure according to claim 10 wherein each pair of facing edge scissor assemblies has an internal scissor assembly extending therebetween.

12. An expandable framework structure according to claim 10 wherein said internal scissor assembly is formed by a pair of internal scissor units connected together at upper and lower internal ends thereof in end-to-end relation and including upper and lower central mounts each having sockets formed between spaced-apart, parallel sidewall portions and fastening pins associated therewith to receive respective upper and lower internal end portions of said internal scissor units pivotally journaled on the respective fastening pins thereof.

13. An expandable framework structure according to claim 12 including a central post assembly operative to support an apex portion of said canopy covering and wherein said upper and lower central sockets include means for supporting said central post assembly.

14. An expandable framework structure according to claim 8 wherein said framework support when in the collapsed state defining a closed framework unit having opposite framework unit ends, said stationary mounts and some of said floating mounts abutting one another to create an uninterrupted first rim at one of said framework unit ends and said slide mounts and others of said floating mounts abutting one another to create an uninterrupted second rim at another of said framework unit ends.

15. An expandable framework structure according to claim 1 wherein said edge scissor assemblies are constructed out of pairs of scissor bars pivotally connected to one another at a common midpoint on a pivot axle.

16. An expandable framework structure according to claim 15 wherein said scissor bars are tubular members having a rectangular cross-section of a selected width and height with said width being less than said height, said pivot axle extending across the respective widths of said scissor bars.

17. An expandable framework structure according to claim 15 wherein each said pivot axle is a noncompressive element formed by a pair of cooperative axle pins which are matably connectable to one another to define spaced-apart heads between which said scissor bars are positioned, said cooperative axle pins including means for limiting the minimum distance between said heads to at least equal to the combined widths of said scissor bars.

18. An expandable framework structure adapted to be folded and stored in a collapsed state and erected in an expanded state on a support surface whereby said framework structure may support a canopy covering above said support surface, comprising:

(a) a plurality of upright corner support members each having a bottom end positionable on the support surface and a top end opposite said bottom end, said corner support members oriented alongside one another in the collapsed state and movable outwardly apart from one another toward the expanded state;

(b) a stationary mount secured to each of said corner support members between its respective said stationary mount and the bottom end thereof;

(c) a slide mount slideably received on each of said corner support members between its respective said stationary mount and the bottom end thereof;

(d) an edge scissor assembly interconnecting adjacent ones of said corner support members, each said edge scissor assembly having a pair of outer upper end portions and a pair of outer lower end portions, said outer upper end portions and said outer lower end portions having a rectangular cross-section;

(e) each of said stationary mounts having a plurality of first sockets, each said first socket having a pair of spaced-apart, parallel first sidewalls and including a first fastening pin disposed therein, each said first socket sized to receive an outer upper end portion of a respective edge scissor assembly with the respective outer upper end portion pivotally journaled on the respective fastening pin thereof, each said first socket and each respective said outer upper end portion sized for close-fitted, mated engagement with one another whereby said first sidewalls may act on the outer upper end along planar contact surfaces to resist lateral and torsional deflections thereof; and (f) each of said slide mounts having a plurality of second sockets, each said second socket having a pair of spaced-apart, facing second sidewalls and including a second fastening pin disposed therein, each said second socket sized to receive an outer lower end portion of a respective edge scissor assembly with the respective outer lower end portion pivotally journaled on the respective fastening pin thereof, each said second socket and each respective outer lower end portion sized for close-fitted, mated engagement with one another whereby said second sidewalls may act on the outer lower end portion along planar contact surfaces to resist lateral and torsional deflections thereof.

19. An expandable framework structure according to claim 18 including a roof support assembly supported above the support surface by said corner support members when in the expanded state, said roof support assembly operative to support said canopy covering.

20. An expandable framework structure according to claim 18 wherein each said edge scissor assembly includes a pair of scissor units connected at upper and lower inner ends thereof in end-to-end relation, each said edge scissor assembly including an upper floating mount and a lower floating mount operative respectively to pivotally connect upper and lower inner end portions of the respective scissor units, each said upper floating socket having a plurality of third sockets, each said third socket having a pair of spaced-apart, parallel third sidewalls and including a third fastening pin disposed therein, each said third socket sized to receive an inner upper end portion of a respective edge scissor unit with the respective inner upper end portion pivotally journaled on the respective third fastening pin thereof, each respective said inner upper end portion having a rectangular cross-section sized for close-fitted, mated engagement between its respective said third sidewalls whereby said third sidewalls resist lateral and torsional deflections of the respective said inner upper end portion and each said lower floating mount having a plurality of fourth sockets, each said fourth socket opening having a pair of spaced-apart, parallel fourth sidewalls and including a fourth fastening pin disposed therein, each said fourth socket sized to receive an inner lower end portion of a respective scissor unit with the respective inner lower end portion pivotally journaled on the respective fourth fastening pin thereof, each respective inner lower end portion having a rectangular cross-section sized for close-fitted, mated engagement between its respective said fourth sidewalls whereby said fourth sidewalls resist lateral and torsional deflections of the respective said inner lower end portion.

21. An expandable framework structure according to claim 20 including a roof support assembly assembly supported above the support surface by said corner support members when in the expanded state, said roof support assembly operative to support said canopy covering.

22. An expandable framework structure according to claim 21 wherein said roof support assembly includes an internal scissor assembly extending between and connected to at least one pair of facing edge scissor assemblies and operative to expand and contract in response to expansion and contraction of said one pair of facing edge scissor assemblies, said internal scissor assembly having internal scissor upper and lower outer ends mounted respectively to said upper and lower floating mounts, said upper floating mounts having fifth socket, each said fifth sidewalls and including a fifth fastening pin disposed therein, each said fifth socket sized to receive an internal scissor outer upper end portion of the internal scissor assembly pivotally journaled on the fifth fastening pin thereof, each respective said internal scissor outer upper end portion having a rectangular cross-section sized for close-fitted, mated engagement between its respective said fifth sidewalls whereby said fifth sidewalls resist lateral and torsional deflections of the respective said internal scissor outer upper end portion, and said lower floating sockets having sixth sockets, each said sixth socket having a pair of spaced-apart, facing sixth sidewalls and including a sixth fastening pin disposed therein, each said sixth socket sized to receive an internal scissor outer lower end portion of the internal scissor assembly pivotally journaled on the sixth fastening pin thereof, each respective said internal scissor outer lower end portion having a rectangular cross-section sized for close-fitted, mated engagement between its respective said sixth sidewalls whereby said sixth sidewalls resist lateral and torsional deflections of the respective said internal scissor outer lower end portion.

* * * * *